US011842592B2

(12) United States Patent
Takahashi et al.

(10) Patent No.: US 11,842,592 B2
(45) Date of Patent: Dec. 12, 2023

(54) MEDIUM PROCESSING DEVICE

(71) Applicants: LAUREL BANK MACHINES CO., LTD., Tokyo (JP); LAUREL MACHINERY CO., LTD., Osaka (JP); LAUREL PRECISION MACHINES CO., LTD., Osaka (JP)

(72) Inventors: Hiroaki Takahashi, Tokyo (JP); Masashi Ohba, Oyama (JP)

(73) Assignees: LAUREL BANK MACHINES CO., LTD., Tokyo (JP); LAUREL MACHINERY, Osaka (JP); LAUREL PRECISION MACHINES CO., LTD., Osaka (JP)

( * ) Notice: Subject to any disclaimer, the term of this patent is extended or adjusted under 35 U.S.C. 154(b) by 370 days.

(21) Appl. No.: 17/277,491

(22) PCT Filed: Sep. 17, 2019

(86) PCT No.: PCT/JP2019/036335
§ 371 (c)(1),
(2) Date: Mar. 18, 2021

(87) PCT Pub. No.: WO2020/066744
PCT Pub. Date: Apr. 2, 2020

(65) Prior Publication Data

US 2021/0350653 A1 Nov. 11, 2021

(30) Foreign Application Priority Data

Sep. 25, 2018 (JP) ..... 2018-178879

(51) Int. Cl.
*G07D 11/40* (2019.01)
*G07D 11/12* (2019.01)
(Continued)

(52) U.S. Cl.
CPC ..... *G07D 11/40* (2019.01); *G07D 9/00* (2013.01); *G07D 11/12* (2019.01); *G07D 11/20* (2019.01); *G07D 2211/00* (2013.01)

(58) Field of Classification Search
CPC ..... G07D 11/40; G07D 9/00; G07D 11/12; G07D 2211/00; G07D 11/26; G07D 11/50;
(Continued)

(56) References Cited

U.S. PATENT DOCUMENTS 6,640,156 B1 * 10/2003 Brooks ..... G07D 11/40 700/223
9,779,573 B2 * 10/2017 Nobuhara ..... G07D 3/00
(Continued)

FOREIGN PATENT DOCUMENTS

CN 108122327 A 6/2018
DE 10340963 A1 4/2005
(Continued)

OTHER PUBLICATIONS

Extended European Search Report dated May 25, 2022 in European Application No. 19865744.7, 8 pages.
(Continued)

*Primary Examiner* — Jeffrey A Shapiro
(74) *Attorney, Agent, or Firm* — Nixon & Vanderhye P.C.

(57) ABSTRACT

A medium processing device includes a main body unit that counts a medium and that is configured to be connectable to at least one medium processing unit that accommodates the medium. The main body unit includes: a plurality of power supply lines including first and second power supply lines, the first and second power supply lines being independent of each other and supplying electric power toward the at least
(Continued)

one medium processing unit, and an output part that outputs a control signal toward the at least one medium processing unit.

5 Claims, 16 Drawing Sheets

(51) Int. Cl.
*G07D 9/00* (2006.01)
*G07D 11/20* (2019.01)

(58) Field of Classification Search
CPC ..... H02J 5/00; H02J 13/00; H02M 7/003; H04Q 1/03
See application file for complete search history.

(56) References Cited

U.S. PATENT DOCUMENTS

2006/0227350 A1* 10/2006 Crawford ..... G05B 19/4185 358/1.12
2010/0217432 A1* 8/2010 Mori ..... G07D 11/40 700/214
2013/0213864 A1* 8/2013 Mennie ..... G07D 11/40 209/534
2017/0169645 A1 6/2017 Nobuhara et al.

FOREIGN PATENT DOCUMENTS

| | | | |
|---|---|---|---|
| EP | 0675465 | A1 | 10/1995 |
| EP | 1 014 314 | A1 | 6/2000 |
| EP | 3333813 | A1 | 6/2018 |
| JP | 07-267513 | | 10/1995 |
| JP | 2001-155220 | | 6/2001 |
| JP | 2015-108856 | | 6/2015 |
| JP | 2016-201046 | A | 12/2016 |

OTHER PUBLICATIONS

Official Action of the Substantive Examination dated Sep. 20, 2021 in Russian Application No. 2021107458, with English translation, 12 pages.
International Search Report for PCT/JP2019/036335, dated Nov. 19, 2019, 4 pages.
Written Opinion of the ISA for PCT/JP2019/036335, dated Nov. 19, 2019, 4 pages.
Chinese Office Action dated May 30, 2022 in Chinese Application No. 201980062440.0, with English translation, 15 pages.

* cited by examiner

MEDIUM PROCESSING DEVICE

TECHNICAL FIELD

The present invention relates to a medium processing device.

This application is the U.S. national phase of International Application No. PCT/JP2019/036335 filed Sep. 17, 2019 which designated the U.S. and claims the benefit of priority from Japanese Patent Application No. 2018-178879, filed Sep. 25, 2018, the entire contents of each of which are hereby incorporated by reference.

BACKGROUND ART

There has heretofore been known a paper sheet storage device that processes and stores paper sheets serving as media and that includes a unit expansion structure to which one or more currency processing units serving a function can be freely added thereto externally. Such a paper sheet storage device can be equipped with currency processing units, depending on the application (for example, see Patent Document 1). The paper sheet storage device disclosed in Patent Document 1 has an internal transport path to which an external transport path provided in the paper sheet storage part can be connected, and a plurality of paper sheet storage parts (currency processing units) according to banknote denominations can be added to the outside of the main body of the device. Accordingly, the number of paper sheet storage parts can be adjusted to the same number as the number of types of paper sheets used, thereby enabling operations to be performed in a device form that is suitable for the purpose of use.

PRIOR ART DOCUMENTS

Patent Documents

[Patent Document 1] Japanese Unexamined Patent Application, First Publication No. H07-267513

SUMMARY OF INVENTION

Problem to be Solved by the Invention

When connecting multiple units to the outside of a currency processing device main body, it is necessary to supply electric power required for the currency processing units including driving components equipped in the added units and electrical components, such as control substrates for the driving components and sensors, from the currency processing device main body to the currency processing units. In the case where multiple currency processing units can be added, electric power still needs to be supplied appropriately even when the maximum number of currency processing units are provided. Therefore, when less than the maximum number of currency processing units are provided, there will be components that cause over-engineering, resulting in an increase in cost.

Therefore, an object of the present invention is to provide a medium processing device capable of suppressing an increase in cost.

Means for Solving the Problem

A medium processing device according to an aspect of the present invention includes a main body unit that counts a medium, the main body unit being configured to be connectable to at least one medium processing unit that accommodates the medium. The main body unit includes: a plurality of power supply lines including first and second power supply lines, the first and second power supply lines being independent of each other and supplying electric power toward the at least one medium processing unit, and an output part that outputs a control signal toward the at least one medium processing unit.

Effect of the Invention

According to the present invention, it is possible to provide a medium processing device capable of suppressing an increase in cost.

EMBODIMENTS FOR CARRYING OUT THE INVENTION

First Embodiment

Hereunder, a paper sheet processing device according to a first embodiment of the present invention will be described, with reference to FIG. 1 to FIG. 15. The paper sheet processing device is an example of a medium processing device. A paper sheet processing device 1 of the first embodiment shown in FIG. 1 performs processing of classifying paper sheets S serving as media, such as banknotes. More specifically, the paper sheet processing device 1 classifies input paper sheets S into counting target paper sheets to be counted and into rejected paper sheets not to be counted. Further, the paper sheet processing device counts the target paper sheets by type and accommodates them by type, and displays the counting result and the accommodation destination in association with each other. In the following description, "front" refers to the operator side, "rear" refers to the opposite side of the operator, "right" refers to the right side as viewed from the operator, and "left" refers to the left side as viewed from the operator.

Figure 1:
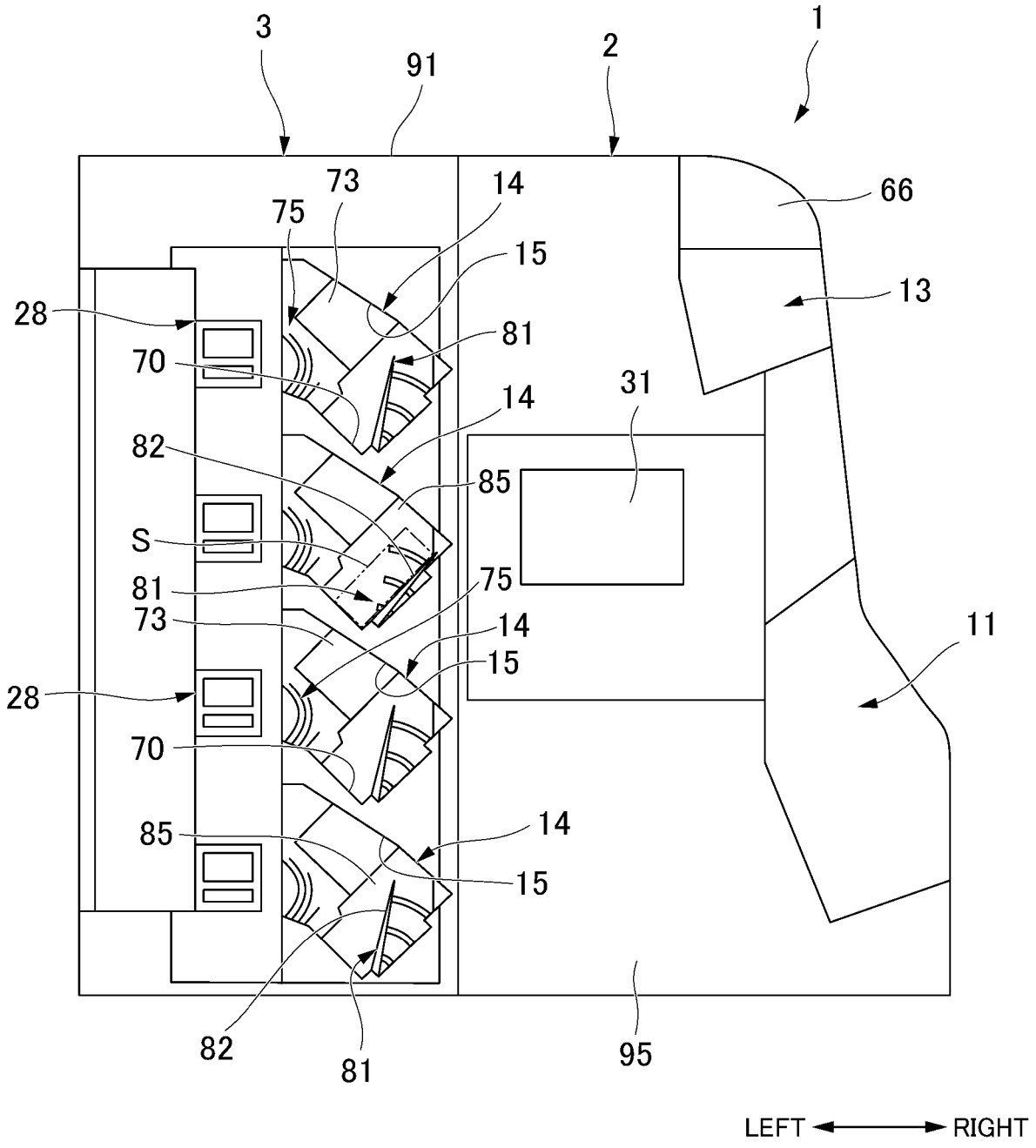
FIG. 1 is a front elevation view showing a basic configuration of a paper sheet processing device according to a first embodiment of the present invention.

The paper sheet processing device 1 of the first embodiment is of a configuration that, as shown in FIG. 1, combines a counting unit 2 (a medium counting main body part, and a main body unit) for counting paper sheets S with an accommodating unit 3 (a medium processing unit) for classifying and accommodating paper sheets S transported from the counting unit 2. The paper sheet processing device 1 is of a configuration such that only a single accommodating unit 3 may be provided for a single counting unit 2, or a plurality of accommodating units 3 may be provided for a single counting unit 2. A basic configuration of the paper sheet processing device 1 is of a configuration such that only a single accommodating unit 3 is provided for a single counting unit 2. In the paper sheet processing device 1, an accommodating unit 3 can be provided as an addition to this basic configuration.

FIG. 1 shows the paper sheet processing device 1 of the basic configuration, which combines only a single accommodating unit 3 with a single counting unit 2. First, the paper sheet processing device 1 of this basic configuration will be described.

Figure 2:
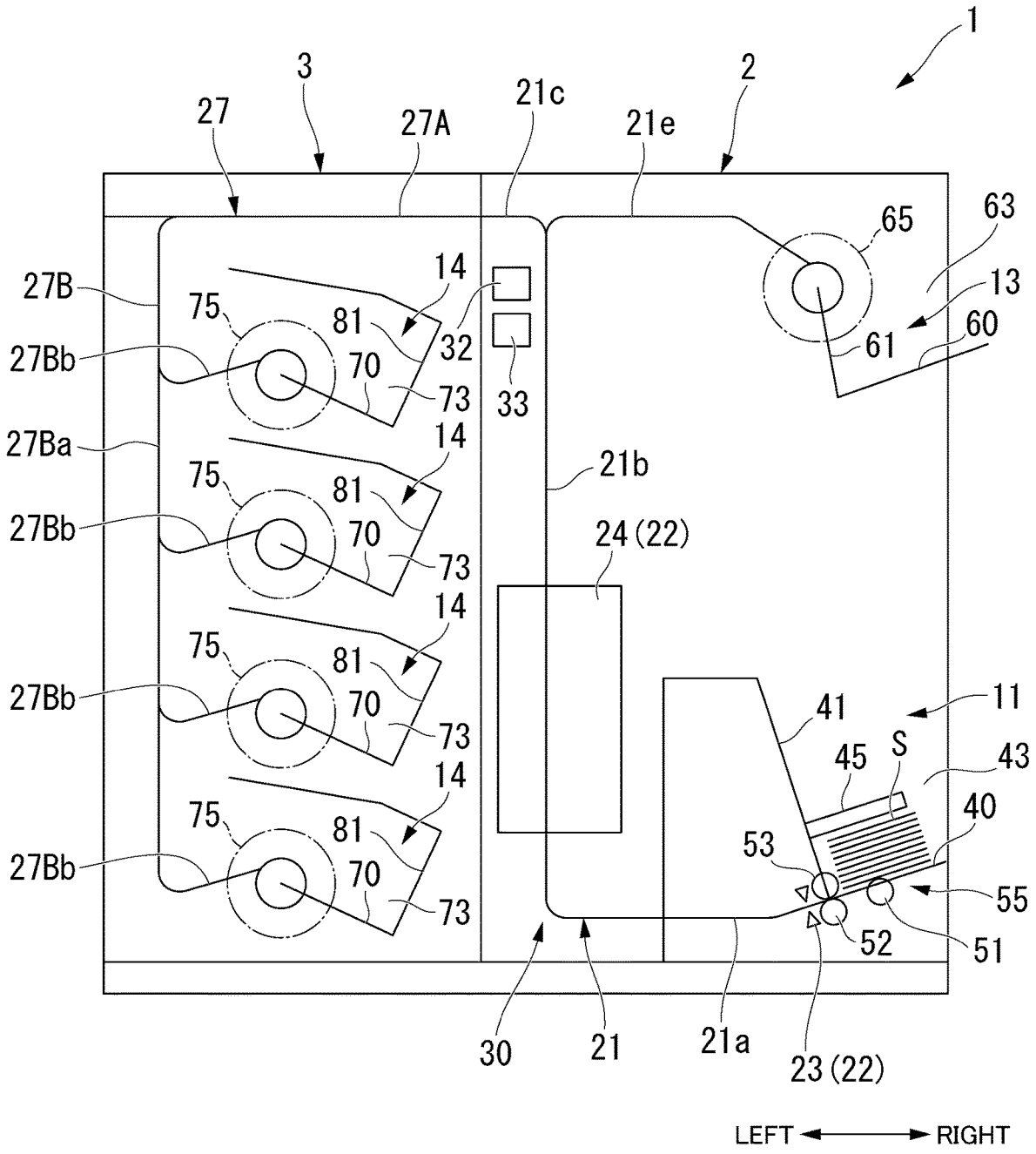
FIG. 2 is an internal schematic configuration diagram showing the basic configuration of the paper sheet processing device according to the first embodiment of the present invention as viewed from the front side.
Figure 3:
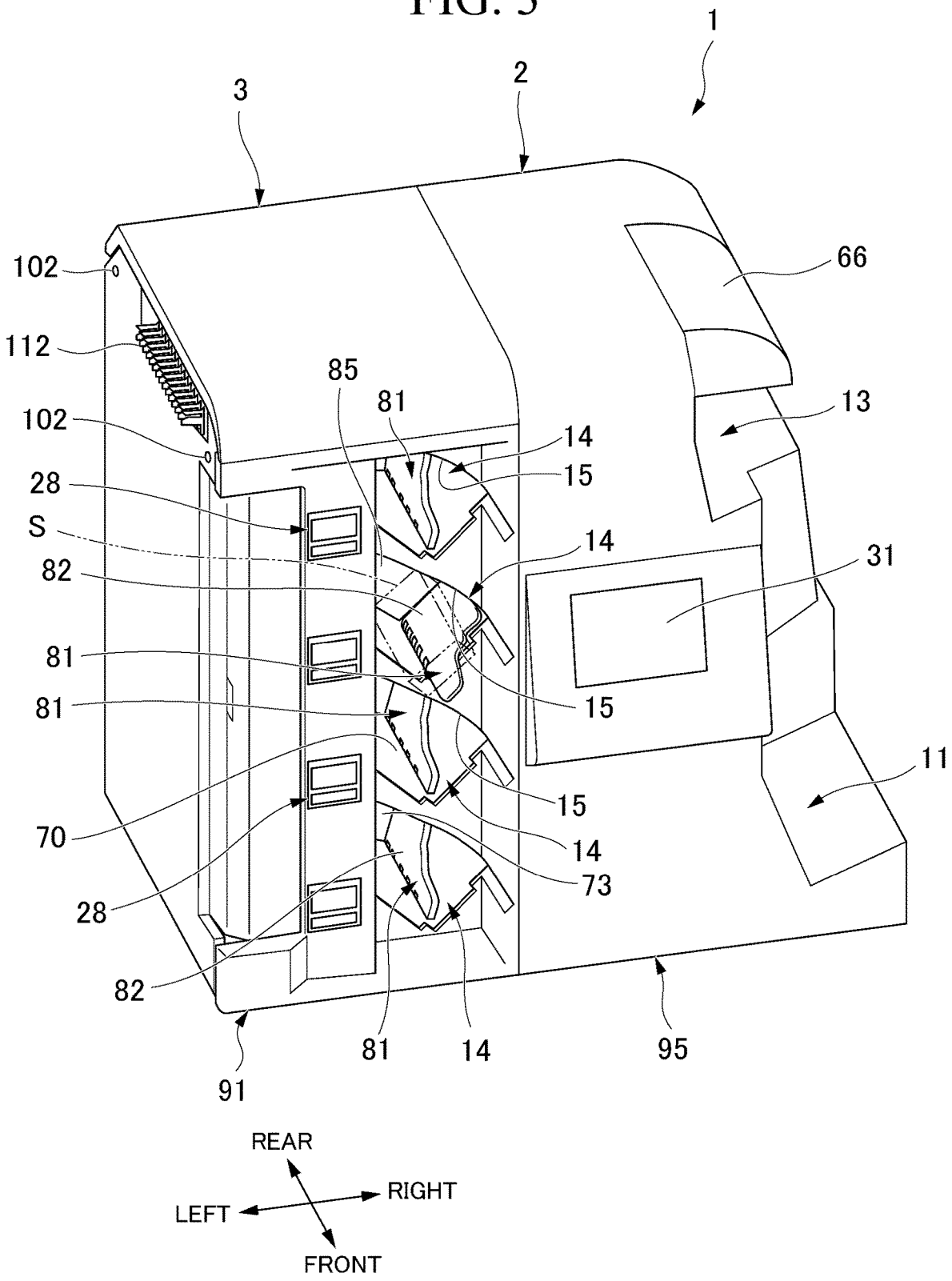
FIG. 3 is a perspective view showing the basic configuration of the paper sheet processing device according to the first embodiment of the present invention.

As shown in FIG. 1 to FIG. 3, the counting unit 2 has a receiving part 11 and a rejection part 13. The receiving part 11 is provided at a lower part on the right-side surface side of the counting unit 2, and is always open to the outside of the counting unit 2, that is, the outside of the paper sheet processing device 1, over the right-side surface and the front surface. The rejection part 13 is provided at an upper part on the right-side surface side of the counting unit 2, and is always open to the outside of the counting unit 2, that is, the outside of the paper sheet processing device 1, over the right-side surface and the front surface. The positions of the rejection part 13 and the receiving part 11 in the front-rear direction are the same. The positions of the rejection part 13 and the receiving part 11 in the left-right direction are the same. The rejection part 13 and the receiving part 11 are arranged in line along the vertical direction.

As shown in FIG. 2, a plurality of paper sheets S are set in the receiving part 11 in a state being accumulated in the vertical direction while the long side (long side part) thereof is aligned with the front-rear, and the short side (short side part) thereof is aligned with the left-right direction. The receiving part 11 separates the accumulated paper sheets S set in this manner one by one, starting with the bottom-most paper sheet, feeds them out, and takes them into the paper sheet processing device 1. The paper sheet S fed from the receiving part 11 moves along the extending direction of the short side thereof.

The counting unit 2 has, inside a casing thereof, an in-counting-unit transport constituent part 21 and an identification part 22. The in-counting-unit transport constituent part 21 transports paper sheets S fed from the receiving part 11. The identification part 22 counts the paper sheets S while identifying the paper sheets S being transported in the in-counting-unit transport constituent part 21. The paper sheets S transported in the in-counting-unit transport constituent part 21 move along the extending direction of the short side thereof. The identification part 22 has a detection part 23 and an identification main body part 24. The detection part 23 is provided at an end part position of the in-counting-unit transport constituent part 21 on the receiving part 11 side, and detects the transporting state of the paper sheets S being fed by the receiving part 11. The identification main body part 24 is provided on the downstream side of the detection part 23 of the in-counting-unit transport constituent part 21, and performs a process different from the detection of the transporting state of paper sheets S, specifically, a process of identifying the type of paper sheets S such as a denomination.

The in-counting-unit transport constituent part 21 has a left extended part 21*a*, an upper extended part 21*b*, a left extended part 21*c*, and a branch extended part 21*e*. The left extended part 21*a* extends from the receiving part 11 toward the left-side surface of the counting unit 2. The upper extended part 21*b* extends upward from an end part near the left-side surface of the left extended part 21*a*. The left extended part 21*c* extends from an upper end part of the upper extended part 21*b* toward the left-side surface of the counting unit 2 and opens to the left-side surface. The branch extended part 21*e* branches on the upper side of the identification part 22 of the upper extended part 21*b*, extends toward the right-side surface of the counting unit 2, and connects to the rejection part 13. In the in-counting-unit transport constituent part 21, the identification part 22 is provided on the upper extended part 21*b* along the vertical direction.

Inside the accommodating unit 3, there is provided an in-accommodating-unit transport constituent part 27. The in-accommodating-unit transport constituent part 27 is connected to the left extended part 21*c* of the counting unit 2 and transports the paper sheets S fed from the left extended part 21*c*. The paper sheets S being transported in the in-accommodating-unit transport constituent part 27 also move along the extending direction of the short side thereof.

The in-accommodating-unit transport constituent part 27 has a connection transport constituent part (medium transport path) 27A and a branch transport constituent part 27B. The connection transport constituent part 27A opens to an upper part of the right-side surface of the accommodating unit 3, extends horizontally and linearly toward the left-side surface of the accommodating unit 3, and opens to an upper part of the left-side surface. The branch transport constituent part 27B branches from the left side portion of the connection transport constituent part 27A to the lower side. The connection transport constituent part 27A and the branch transport constituent part 27B each have a separate driving motor and the driving motors can be driven independently of each other. Here is described a case where a plurality of accommodating units 3 are provided in a continuous manner with respect to one counting unit 2. In such a case, the plurality of accommodating units 3 are arranged connected in line along the left-right direction. One of the plurality of accommodating units 3 is directly connected to the connection transport constituent part 27A. The other accommodating units 3 are connected to the connection transport constituent part 27A via the adjacent accommodating unit 3.

The branch transport constituent part 27B has a lower extended part 27Ba and a plurality of, specifically, four side extended parts 27Bb. The lower extended part 27Ba branches from the left side of the connection transport constituent part 27A and extends vertically downward. One of the four side extended parts 27Bb extends from a lower end position of the lower extended part 27Ba toward the right-side surface of the accommodating unit 3. A plurality of, specifically, three of the four side extended parts 27Bb branch from intermediate positions of the lower extended part 27Ba and extend toward the right-side surface of the accommodating unit 3. Accommodating parts 14 for accumulating and accommodating paper sheets S are connected to each of the four side extended parts 27Bb. Therefore, one accommodating unit 3 is provided with a plurality of, specifically, four accommodating parts 14. The embodiment of the present invention is not limited to the case where one accommodating unit 3 is provided with a plurality of, specifically, four accommodating parts 14. For example, one accommodating unit 3 may be provided with a plurality of, specifically, three accommodating parts 14.

As shown in FIG. 1 and FIG. 3, each of the plurality of accommodating parts 14 has an opening part 15 provided in the front surface of the accommodating unit 3, that is, the front surface of the paper sheet processing device 1. The plurality of accommodating parts 14 are, at each opening part 15, always open to the outside of the accommodating part 3, that is, the outside of the paper sheet processing device 1. A plurality of, specifically, four status display parts 28 are provided on the front surface of the accommodating unit 3, that is, the front surface of the paper sheet processing device 1. The four status display parts 28 each correspond to the four accommodating parts 14 in a one-to-one manner. The height-wise position of each status display part 28 is aligned with the height-wise position of the corresponding accommodating part 14. Each status display part 28 is positioned on the left side of the corresponding accommodating part 14. Each status display part 28 displays the status, such as the number, of paper sheets S accumulated in the corresponding accommodating part 14.

The positions of the plurality of accommodating parts 14 in the front-rear direction are aligned. Moreover, the positions of the plurality of accommodating parts 14 in the front-rear direction are aligned. The plurality of accommodating parts 14 are arranged in line at predetermined intervals in the vertical direction (height direction). The positions of the plurality of accommodating parts 14 in the front-rear direction align with the positions of the receiving part 11 and the rejection part 13 provided in the counting unit 2.

As shown in FIG. 2, the in-counting-unit transport constituent part 21 and the in-accommodating-unit transport constituent part 27, which are connected to each other, constitute a transport part 30 for transporting the paper sheets S fed from the receiving part 11. When paper sheets S are identified by the identification part 22 while being transported by the transport part 30, the portion of the transport part 30 on the downstream side of the identification part 22 sorts the paper sheets S selectively into one of the rejection part 13 and the plurality of accommodating parts 14, on the basis of the identification result of the identification part 22.

In the paper sheet processing device 1, the rejection part 13 and the plurality of accommodating parts 14 classify the paper sheets S on the basis of the identification result of the identification part 22 and accommodate them to be able to be removed to the outside of the paper sheet processing device 1. In the plurality of accommodating parts 14, the paper sheets S are pulled out from the opening part 15 provided in the front surface of the paper sheet processing device 1 toward the front of the paper sheet processing device 1.

As shown in FIG. 2, among the paper sheets S taken into the paper sheet processing device 1 by the receiving part 11, the paper sheets S identified by the identification part 22 as rejected paper sheets, which are paper sheets other than counting target paper sheets, are transported to the rejection part 13. The rejection part 13 accepts the transported paper sheets S, and accommodates the accumulated paper sheets S so as to be able to be removed to the outside of the paper sheet processing device 1. The in-counting-unit transport constituent part 21 feeds the paper sheets S out to the rejection part 13. The rejection part 13 accumulates the paper sheets S being fed out in this manner from bottom to top in the feeding out order (in other words, the order of the receiving part 11 taking the sheets in). When fed from the branch extended part 21*e* of the in-counting-unit transport constituent part 21 out to the rejection part 13, the paper sheets S are accumulated from bottom to top while the long sides thereof are aligned with the front-rear direction and the short sides thereof are aligned with the left-right direction in the rejection part 13.

Among the paper sheets S taken into the paper sheet processing device 1 by the receiving part 11, the paper sheets S identified by the identification part 22 as counting target paper sheets and counted by type are transported to the plurality of accommodating parts 14 by type. The plurality of accommodating parts 14 accept the transported paper sheets S, and accommodate the accumulated paper sheets S so as to be able to be removed to the outside of the paper sheet processing device 1. The in-accommodating-unit transport constituent part 27 feeds the paper sheets S out to one of the plurality of accommodating parts 14 according to the type of paper sheets S. Each accommodating part 14 accumulates the paper sheets S being fed out in this manner in the direction from bottom right to top left in the feeding out order (in other words, the order of the receiving part 11 taking the sheets in).

As shown in FIG. 1 and FIG. 3, an operation display part 31 is provided on the front surface of the counting unit 2 of the paper sheet processing device 1. The operation display part 31 accepts operation inputs and displays various types of information. Moreover, as shown in FIG. 2, a control part 32 and a memory storage part 33 are provided inside the counting unit 2. The control part 32 controls each part of the counting unit 2 and the accommodating unit 3 connected to the counting unit 2. The memory storage part 33 stores master data serving as an identification reference, data of identification count results, and so forth. The control part 32 controls the entire paper sheet processing device 1.

As described above, the receiving part 11 is provided so as to be always open to the right and to the front on the right-side surface of the paper sheet processing device 1. The receiving part 11 has a bottom part 40, a wall part 41, and a wall part 43. The bottom part 40 is arranged so as to be slightly inclined downward to the left with respect to the horizontal direction. The wall part 41 extends upward from the left end position of the bottom part 40 so as to be perpendicular to the bottom part 40. The wall part 43 extends vertically upward from the rear end edge part of the bottom part 40. The bottom part 40 and the wall part 41 extend in the front-rear direction, and the wall part 43 extends in the vertical direction and in the left-right direction. The bottom part 40, the wall part 41, and the wall part 43 are arranged perpendicular to each other. The paper sheets S are accumulated in the receiving part 11 with one long side thereof being in contact with the wall part 41 and one short side thereof being in contact with the wall part 43, and are set on the bottom part 40. The receiving part 11 has a bill press 45. The bill press 45 is provided above the bottom part 40 and moves up and down along the wall part 41. The bill press 45 presses the paper sheets S placed on the bottom part 40 toward the bottom part 40.

The receiving part 11 has a kicking roller 51, a taking-in roller 52, and a separating roller 53. The kicking roller 51 kicks the bottom-most paper sheet S of the paper sheets S set on the bottom part 40 toward the in-counting-unit transport constituent part 21 on the left. The taking-in roller 52 takes in the paper sheet S kicked out by the kicking roller 51 into the paper sheet processing device 1 and delivers it to the in-counting-unit transport constituent part 21. The separating roller 53 separates the paper sheets S one by one to be taken in by the taking-in roller 52. The kicking roller 51, the taking-in roller 52, and the separating roller 53 form a taking-in part 55 that separates the paper sheets S set in the receiving part 11 one by one and takes them into the paper sheet processing device 1.

The detection part 23 of the identification part 22 mentioned above is arranged at a position in the vicinity of the receiving part 11 in the left extended part 21*a* of the in-counting-unit transport constituent part 21, and detects whether or not paper sheets S are being fed out and the state of transporting paper sheets S. The detection part 23 detects the presence or absence of double feeding on the basis of the light transmittance or the physical thickness of the paper sheet S. The detection part 23 detects the presence or absence of skew from the difference in detection timing on both sides of the paper sheet S in the long side direction. The detection part 23 detects the presence or absence of near feeding on the basis of the intervals between the detection timings of the adjacent paper sheets S. The paper sheets S detected by the detection part 23 as having no double feeding, no skewing, and no near feeding are, in other words, paper sheets S detected by the detection part 23 as being normally transported.

The identification main body part 24 of the identification part 22 detects images of a paper sheet S when irradiated with visible light and when irradiated with ultraviolet rays, and compares each detected image with reference data. The identification main body part 24 identifies the type of the paper sheet S as the type of reference data determined as matching the image of the paper sheet S. The paper sheet S, the type of which has been specified in this manner, is a paper sheet S that has no identification abnormality. On the other hand, when there is no reference data determined to match the image of the paper sheet S, the identification main body part 24 identifies the paper sheet S as a paper sheet S having an identification abnormality.

The rejection part 13 has a bottom part 60, a wall part 61, and a wall part 63. The bottom part 60 is arranged so as to be slightly inclined downward to the left with respect to the horizontal direction. The wall part 61 extends upward from the left end position of the bottom part 60 so as to be substantially perpendicular to the bottom part 60. The wall part 63 extends vertically upward from the rear end edge part of the bottom part 60. The bottom part 60 and the wall part 61 extend in the front-rear direction, and the wall part 63 extends in the vertical direction and in the left-right direction.

An impeller 65 is provided at the upper part of the wall part 61. The impeller 65 is provided in the vicinity of the terminal position of the branch extended part 21*e* of the in-counting-unit transport constituent part 21, and feeds out paper sheets S transported by the branch extended part 21*e* to be accumulated on the bottom part 60. The impeller 65 rotates together with the paper sheet S transported by the branch extended part 21*e* while sandwiching it between the blades, and pushes, by means of the blades, the paper sheet S toward the bottom part 60 side, that is, downward when the paper sheet S comes in contact with the wall part 61 and leaves from between the blades.

The rejection part 13 has a paper sheet presence/absence detection sensor (not shown in the drawings) that detects the presence or absence of paper sheets S in the rejection part 13, and a presence/absence indicator lighting (not shown in the drawings) that can switch the lighting state on the basis of the detection result of the paper sheet presence/absence detection sensor. The presence/absence indicator lighting is lit when the presence of paper sheets S in the rejection part 13 is detected by the paper sheet presence/absence detection sensor, and is not lit when an absence of paper sheets S in the rejection part 13 is detected by the paper sheet presence/absence detection sensor. Moreover, the presence/absence indicator lighting blinks, for example, when the rejection part 13 is in the state of being full of paper sheets S.

The presence/absence indicator lighting is provided, for example, on the bottom part 60 so as to emit light outward at the front surface position and right-side position of the counting unit 2, that is, the paper sheet processing device 1. The presence/absence indicator lighting may be provided on a cover 66 shown in FIG. 1 and FIG. 3. In such a case, the cover may be made of a transparent material so that the entire cover is illuminated. The cover 66 guides paper sheets S fed out by the impeller 65 and collects them on the bottom part 60.

Each of the plurality of accommodating parts 14 has the same configuration, and has an opening part 15, an accommodating bottom part 70, and an accommodating back wall part 73. The opening part 15 opens to the front surface of the paper sheet processing device 1. The accommodating bottom part 70 is inclined downward to the right with respect to the horizontal direction. The accommodating back wall part 73 extends on the rear side of the accommodating bottom part 70. The accommodating bottom part 70 has an upper surface that faces upwards thereof. The upper surface 71 is inclined downward to the right and extends in the front-rear direction. The accommodating back wall part 73 has a front surface facing forward thereof. The front surface of the accommodating back wall part 73 extends in the vertical direction and the left-right direction, in other words, extends in a direction orthogonal to the front-rear direction.

The accommodating unit 3 has a sliding stage part 81 arranged inside each of the accommodating parts 14. The sliding stage part 81 is provided so as to be able to slide with respect to the accommodating part 14 between a retraction end position at which the entire sliding stage part 81 is arranged in the accommodating part 14 and an advancement end position at which a part of the sliding stage part 81 projects from the opening part 15 of the accommodating part 14. In the example shown in FIG. 3, the first, third, and fourth sliding stage parts 81 from the top in FIG. 3 are positioned at the retraction end position. The second sliding stage part 81 from the top in FIG. 3 is positioned at the advancement end position. When positioned at the retraction end position, the sliding stage part 81 is in a waiting state where it accepts paper sheets S. When positioned at the advancement end position, the sliding stage part 81 is in a push-out state where it pushes out the accommodated paper sheets S forward.

In the accommodating unit 3, a plurality of sliding stage parts 81 can slide with respect to a unit main body 91 including the plurality of accommodating parts 14 and the plurality of status display parts 28. This unit main body 91 has a front surface facing forward. On the front surface of the unit main body 91 there are arranged openings 15 of the plurality of accommodating part 14. The plurality of status display parts 28 form a part of the front surface of the unit main body 91. The unit main body 91 of the accommodating unit 3 and the counting unit 2 form a device main body 95 of the paper sheet processing device 1. The front surface of the unit main body 91 forms a part of the front surface facing the front of the device main body 95. The plurality of sliding stage parts 81 can also slide with respect to the device main body 95. The openings 15 of the plurality of accommodating parts 14 are arranged in the front surface of the device main body 95. The plurality of status display parts 28 form a part of the front surface of the device main body 95.

Each sliding stage part 81 has a supporting stage 82 and a push-out stage 85. The supporting stage 82 extends upward to the right with respect to the horizontal direction, from the right end position of the accommodating bottom part 70. The push-out stage 85 extends on the rear side of the supporting stage 82. The supporting stage 82 has a supporting surface facing the accommodating bottom part 70 side. The supporting surface of the supporting stage 82 is inclined upward to the right and extends in the front-rear direction. The push-out stage 85 has a front surface facing forward thereof. The front surface of the push-out stage 85 extends in the vertical direction and in the left-right direction. In other words, the front surface of the push-out surface 85 extends in the direction orthogonal to the front-rear direction. The upper surface of the accommodating bottom part 70 and the front surface of the push-out stage 85 extend in the direction orthogonal to the upper surface of the accommodating bottom part 70 and the supporting surface of the supporting stage 82.

As shown in FIG. 2, an impeller 75 is provided at a terminal position of each side extended part 27Ba of the branch transport constituent part 27B. Each impeller 75 feeds out paper sheets S into the corresponding accommodating part 14. Each impeller 75 is provided on the side opposite to the supporting stage 82 of the accommodating bottom part 70 in the accommodating part 14, that is, on the left side. Each impeller 75 has a number of impeller blades provided at predetermined intervals in the circumferential direction and extending on the same side in the circumferential direction. The impeller 75 rotates so that the portion opposed to the supporting stage 82 moves from the upper side to the lower side. In the state where the impeller blade 76 faces the supporting stage 82, the fixed end thereof is positioned on the lower side and the free end thereof is positioned on the upper side.

The impeller 75 rotates together with a paper sheet S that is being transported from the left side to the right side by one of the corresponding four side extended parts 27Bb and the lower extended part 27Ba of the branch transport constituent part 27B, while sandwiching the paper sheet S between the blades. When the paper sheet S comes in contact with the upper surface of the accommodating bottom part 70 and comes out from between the blades, the impeller 75 pushes the paper sheet S toward the supporting stage 82 side by means of the blades. At this time, the paper sheet S is supported by the accommodating bottom part 70 in the state where the short side thereof is aligned with the vertical direction and the long side of the lower end thereof is in contact with the upper surface of the accommodating bottom part 70, and the paper sheet S is guided by the upper surface and moves toward the supporting surface side of the supporting stage 82. As a result, the paper sheet S is supported by the upper surface of the accommodating bottom part 70 and the supporting surface of the supporting stage 82 in the state where the surface thereof on one side in the thickness direction overlaps with the supporting surface of the supporting stage 82. Similarly, the paper sheet S fed out next is supported by the accommodating bottom part 70 in the state where the short side thereof is aligned with the vertical direction and the long side of the lower end thereof is in contact with the upper surface of the accommodating bottom part 70, and the paper sheet S is guided by the upper surface and moves toward the supporting surface side of the supporting stage 82. As a result, the paper sheet S is supported by the supporting stage 82 in the state where the surface on one side thereof in the thickness direction overlaps with the surface on the other side in the thickness direction of the paper sheet S having already been supported by the supporting stage 82. In this manner, the paper sheets S are sequentially accumulated in the thickness direction and placed on the supporting surface of the supporting stage 82. Each of the plurality of accommodating parts 14 is also provided with a paper sheet presence/absence detection sensor and a presence/absence indicator lighting similar to those of the rejection part 13. For example, the presence/absence indicator lighting of the accommodating part 14, on the accommodating bottom part 70, emits light outward from a front surface position of the accommodating unit 3, that is, the paper sheet processing device 1.

The sliding stage part 81 supports the banknotes fed out into the accommodating part 14 in the waiting state, by means of the supporting stage 82. As the number of paper sheets S fed out into the accommodating part 14 and accumulated on the supporting stage 82 increases, the supporting stage 82 tilts at angles according to the number of the accumulated paper sheets S.

Here is described a case where the user is to receive paper sheets S fed out into the accommodating part 14. In this case, as shown in the second accommodating part 14 from the top in FIG. 3, the sliding stage part 81 advances from the waiting state, and thereby the supporting stage 82 and the push-out stage 85 cause a part of the paper sheets S being accommodated to protrude forward from the opening part 15 of the accommodating part 14.

Figure 4:
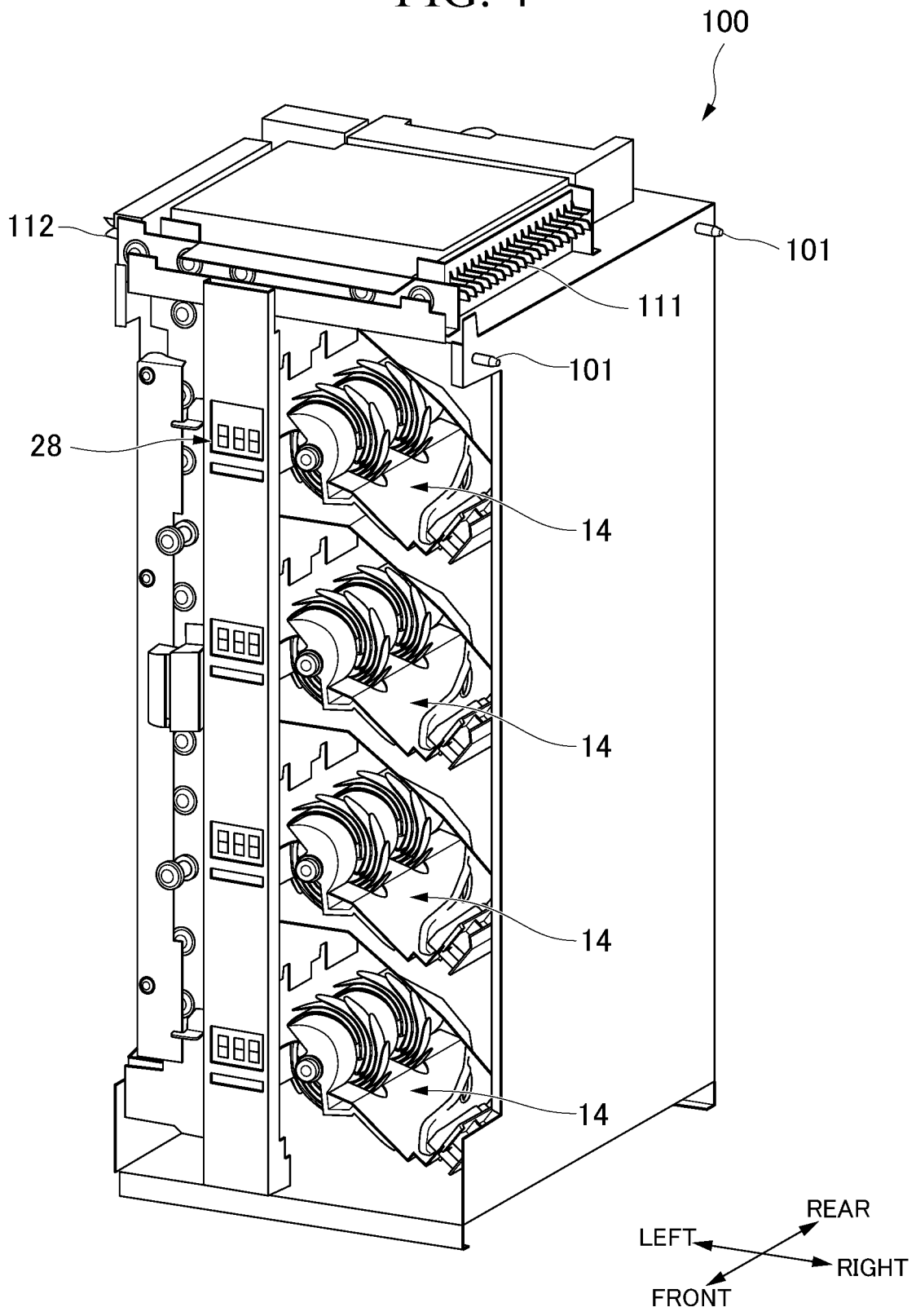
FIG. 4 is a perspective view showing an accommodating unit main body part of the paper sheet processing device according to the first embodiment of the present invention.
Figure 5:
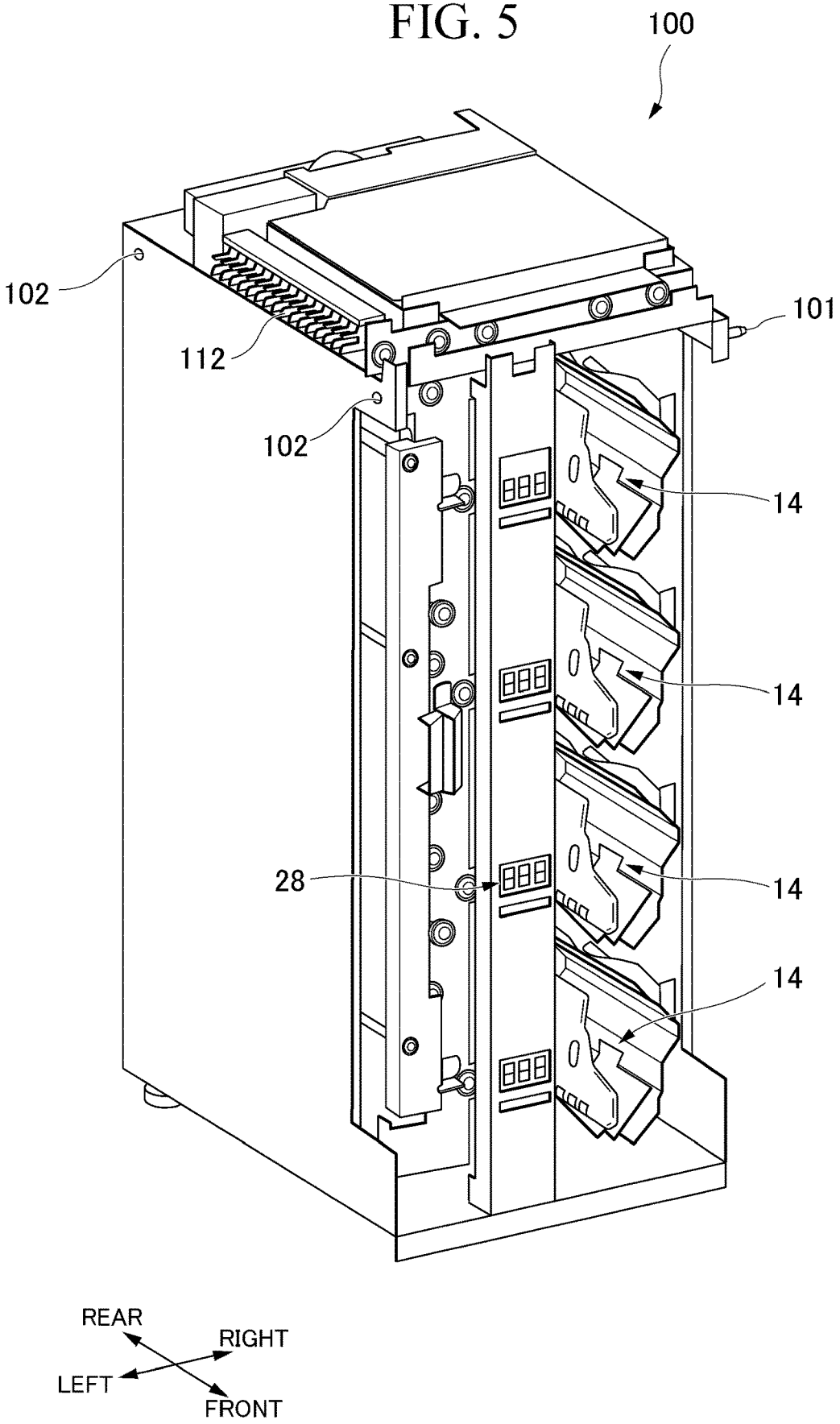
FIG. 5 is a perspective view showing the accommodating unit main body part of the paper sheet processing device according to the first embodiment of the present invention.

FIG. 4 and FIG. 5 show an accommodating unit main body part 100 in a state where covers are removed from the accommodating unit 3 shown in FIG. 3. As shown in FIG. 4, two unit coupling pins 101 are provided on an upper part of the right-side surface of the accommodating unit main body part 100 so as to be separated from each other in the front-rear direction. The two unit coupling pins 101 are fitted into coupling holes (omitted in the drawings) formed in the counting unit 2 when the accommodating unit 3 is connected to the counting unit 2. By fitting these unit coupling pins 101 into the coupling holes of the counting unit 2, the accommodating unit 3 is positioned so as to align the position thereof with the counting unit 2 in the vertical direction and in the front-rear direction. In the state where positioning has been done in this manner, the accommodating unit 3 is connected and fixed to the counting unit 2, and the accommodating unit 3 and the counting unit 2 are integrated.

As shown in FIG. 5, two coupling holes 102 are provided on an upper part of the left-side surface of the accommodating unit main body part 100 so as to be separated from each other in the front-rear direction. When another accommodating unit 3 is provided on the side opposite to the counting unit 2 of one accommodating unit 3 provided with these coupling holes 102, the unit coupling pins 101 on the right-side surface of the other accommodating unit 3 are fitted in the coupling holes 102. By fitting the unit coupling pins 101 of the other accommodating unit 3 into the coupling holes 102 of the one accommodating unit 3, the other accommodating unit 3 is positioned so as to align the position thereof with the one accommodating unit 3 in the vertical direction and in the front-rear direction. In the state where positioning has been done in this manner, the other accommodating unit 3 is connected and fixed to the one accommodating unit 3, and the other accommodating unit 3 and the two-unit one accommodating unit 3 are integrated.

As shown in FIG. 4, a transport entry part 111 is provided on the right side of the upper part of the accommodating unit main body part 100. When the accommodating unit 3 is connected to the counting unit 2 shown in FIG. 2, the transport entry part 111 is connected to a transport exit part (omitted in the drawings) that constitutes an exit portion of the left extended part 21*c* of the in-counting-unit transport constituent part 21 of the counting unit 2. As a result, paper sheets S can be transferred between the counting unit 2 and the accommodating unit 3. The transport entry part 111 constitutes an entry portion of the connection transport constituent part 27A.

As shown in FIG. 5, a transport exit part 112 that constitutes the exit portion of the connection transport constituent part 27A shown in FIG. 2 is provided on the left side of the upper part of the accommodating unit main body part 100. When another accommodating unit 3 is provided on the side opposite to the counting unit 2 of one accommodating unit 3 provided with the transport exit part 112, the transport exit part 112 is connected to the transport entry part 111 on the right side of the upper part of the other accommodating unit 3. As a result, paper sheets S can be transferred between the one accommodating unit 3 and the other accommodating unit 3.

Figure 6:
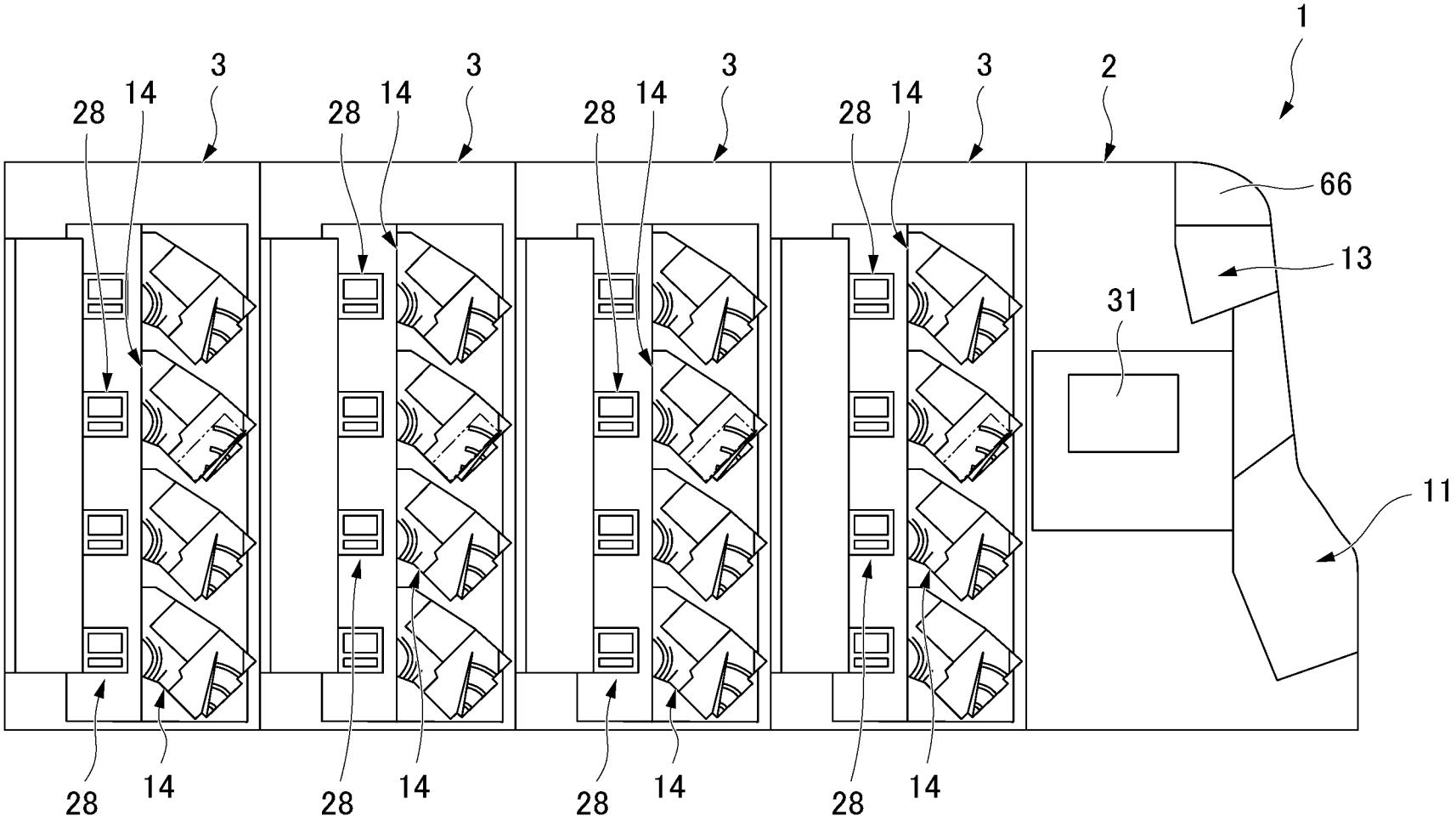
FIG. 6 is a front elevation view showing one example configuration of the paper sheet processing device according to the first embodiment of the present invention.

As described above, the basic configuration of the paper sheet processing device 1 combines only a single accommodating unit 3 with a single counting unit 2. For example, the paper sheet processing device 1 may be of a configuration such that a single accommodating unit 3 is added to the basic configuration. The paper sheet processing device 1 may also be of a configuration such that two accommodating units 3 are added to the basic configuration. As shown in FIG. 6, the paper sheet processing device 1 may also be of a configuration such that three accommodating units 3 are added to the basic configuration. In this way, it is possible to provide up to a preliminarily set maximum number of accommodating units 3 for a single counting unit 2. That is to say, the accommodating unit 3 has: the connection transport constituent part 27A connected in series with the counting unit 2; can be additionally provided for the counting unit 2; and processes paper sheets S transported from the counting unit 2. The paper sheet processing device 1 is provided with one or more accommodating units 3. The reason for the paper sheet processing device 1 to employ such a form is so that, when the user uses the paper sheet processing device 1 for sorting or accumulating loaded paper sheets S, flexibly will be offered to adapt to circumstances where the number of accommodating parts 14 required by the user varies depending on the types of paper sheets S being handled. Thus, there is an advantage that variations of the paper sheet processing devices 1 can be easily increased without having to change the design thereof.

Figure 7:
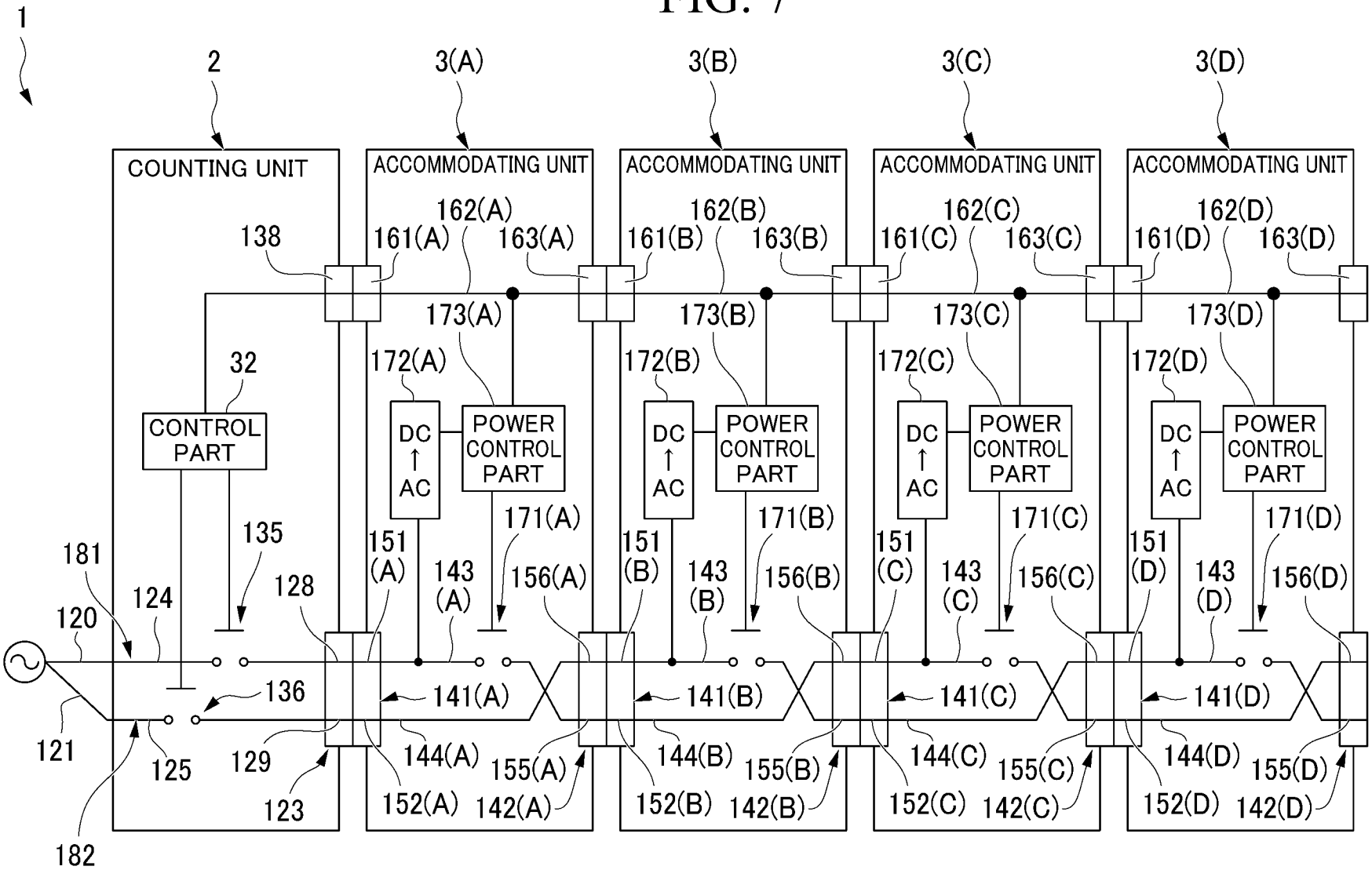
FIG. 7 is a diagram showing a power source system of the one example configuration of the paper sheet processing device according to the first embodiment of the present invention.

FIG. 7 shows an example of an electrical system of the paper sheet processing device 1. As shown in FIG. 7, the counting unit 2 has a first power source connection part 120, a second power source connection part 121, a second power source connection part 121, a power output part (power source output part) 123, a power supply line (a power source supply line, a first power source supply line) 124, and a power supply line (a power source supply line, a second power source supply line) 125. The first power source connection part 120 is connected to an external commercial AC power source to supply electric power from the commercial AC power source. The second power source connection part 121 is connected to an external commercial AC power source to supply electric power from the commercial AC power source. When the accommodating unit 3 is connected to the counting unit 2, the power output part 123 is connected to the accommodating unit 3 so as to be able to supply electric power to the accommodating unit 3. The power supply line 124 connects the first power source connection part 120 and the power output part 123 so that electric power can be supplied from the first power source connection part 120 to the power output part 123. The power supply line 125 connects the second power source connection part 121 and the power output part 123 so that electric power can be supplied from the second power source connection part 121 to the power output part 123.

The first power source connection part 120 includes two lines, a live side (ACL) and a dead side (ACD) of a commercial two-phase power source (for example, AC 100V in Japan) line that is also used for general household use. The second power source connection part 121 has a configuration similar to that of the first power source connection part 120. The power output part 123 is a part that supplies electric power from the counting unit 2 to the subordinate accommodating unit 3. The power output part 123 has an output system 128 and an output system 129, which are two independent electrical systems for sending alternating current.

Moreover, the counting unit 2 has a first switch 135, a second switch 136, the control part 32 mentioned above, and an I/F (interface) output part (an output part) 138. The first switch 135 is a relay provided in the power supply line 124 to switch the state of the power supply line 124 between the ON state and the OFF state. The second switch 136 is a relay provided in the power supply line 125 to switch the state of the power supply line 125 between the ON state and the OFF state. The control part 32 controls the first switch 135 to switch the power supply line 124 between the ON state and the OFF state, and controls the second switch 136 to switch the power supply line 125 between the ON state and the OFF state. When the accommodating unit 3 is connected to the counting unit 2, the I/F output part 138 is communicably connected to the accommodating unit 3. The I/F output part 138 outputs control signals of the control part 32.

When the first switch 135 is brought to the ON state, the power supply line 124 is brought to the ON state. When in the ON state, the power supply line 124 is in the conducting state where electric power from the first power source connection part 120 can be supplied to the output system 128 of the power output part 123. When the first switch 135 is brought to the OFF state, the power supply line 124 is brought to the OFF state. When in the OFF state, the power supply line 124 is in the non-conducting state where electric power from the first power source connection part 120 cannot be supplied to the output system 128 of the power output part 123.

When the second switch 136 is brought to the ON state, the power supply line 125 is brought to the ON state. When in the ON state, the power supply line 125 is in the conducting state where electric power from the second power source connection part 121 can be supplied to the output system 129 of the power output part 123. When the second switch 136 is brought to the OFF state, the power supply line 125 is brought to the OFF state. When in the OFF state, the power supply line 125 is in the non-conducting state where electric power from the second power source connection part 121 cannot be supplied to the output system 129 of the power output part 123.

As described above, the counting unit 2 has the two systems of the power supply line 124 and the power supply line 125 for supplying electric power to the accommodating units 3 and the I/F output part 138 for outputting control signals to the accommodating units 3.

The accommodating unit 3 has a power input part (a power source input part) 141, a power output part (a power source output part) 142, a power supply line (a power source supply line) 143, and a power supply line 144. When the accommodating unit 3 is connected to the counting unit 2, the power input part 141 is connected to the power output part 123 of the counting unit 2, thereby enabling supply of electric power from the power output part 123. When another accommodating unit 3 is connected to the opposite side of the counting unit 2, the power output part 142 is connected to the other accommodating unit 3 so as to be able to supply electric power to the other accommodating unit 3. The power supply line 143 connects the power input part 141 and the power output part 142 so that electric power can be supplied from the power input part 141 to the power output part 142. The power supply line 144 connects the power input part 141 and the power output part 142 so that electric power can be supplied from the power input part 141 to the power output part 142. The power supply line 143 and the power supply line 144 are provided in the interior of the accommodating unit 3.

The power input part 141 has an input system 151 and an input system 152, which are two independent electrical systems receiving alternating current. The input system 151 is connected to the power supply line 143. The input system 152 is connected to the power supply line 144.

The power output part 142 is a part that supplies electric power from the accommodating unit 3 to the other accommodating unit 3 on the opposite side of the counting unit 2. The power output part 142 has an output system 155 and an output system 156, which are two independent electrical systems for sending alternating currents. The physical positions of the power supply line 143 and the power supply line 144 are interchanged immediately before the power output part 142. The power supply line 143 and the power supply line 144 are connected to the power output part 142. The output system 156 is connected to the power supply line 144, and the output system 155 is connected to the power supply line 143.

The accommodating unit 3 has an I/F input part 161, a communication line 162, and an I/F output part 163. When the accommodating unit 3 is connected to the counting unit 2, the I/F input part 161 is communicably connected to the I/F output part 138 of the counting unit 2. The communication line 162 is connected to the I/F input part 161. When the I/F output part 163 is connected to the opposite side of the I/F input part 161 of the communication line 162 and the other accommodating unit 3 is connected to the opposite side of the counting unit 2, it is communicably connected to the other accommodating unit 3. Here, the word "output" in the name I/F output part 138 is used to mean that control signals are output from the I/F output part 138 of the counting unit 2, which is a superordinate unit in terms of control, toward the I/F input part 161 of the accommodating unit 3, which is a subordinate unit in terms of control. However, in reality, the I/F input part 161 on the subordinate side may respond to the I/F output part 138 on the superordinate side in some cases, and therefore, the I/F output part 138 is an input/output port, in terms of electrical signals.

Moreover, the accommodating unit 3 has a switch 171(*a* switching part, switching means), an AC/DC conversion part 172, and a power control part (a power source control part) 173. The switch 171 is a relay provided in the power supply line 143 to switch the state of the power supply line 143 between the ON state and the OFF state. The AC/DC conversion part 172 is connected between the power input part 141 of the power supply line 143 and the switch 171, thereby enabling supply of electric power from the power supply line 143. The power control part 173 receives supply of electric power from the AC/DC conversion part 172, and controls the switch 171 to switch the power supply line 143 between the ON state and the OFF state. Thus, the AC/DC conversion part 172 is connected to the power supply line 143, and the switch 171 is arranged on the power supply line 143.

The power control part 173 is connected to the communication line 162 and receives control signals from the control part 32 of the superordinate counting unit 2, and controls the switch 171 to switch the power supply line 143 between the ON state and the OFF state, on the basis of the control signals. There is no switch provided in the power supply line 144 to switch the state of the power supply line 144 between the ON state and the OFF state. In other words, the switch 171 is provided only in one-system power line (the power supply line 143) of the two-system power supply lines (the power supply line 143 and the power supply line 144) of one accommodating unit 3. The AC/DC conversion part 172 is composed of a switching regulator and so forth.

When the power output part 123 of the counting unit 2 is connected to the power input part 141 of the accommodating unit 3 adjacent thereto so that electric power can be supplied thereto, the power supply line 124 and the output system 128 of the counting unit 2 are connected to the input system 151 and the power supply line 143 of the power input part 141 of the adjacent accommodating unit 3 so that electric power can be supplied thereto. Moreover, the power supply line 125 and the output system 129 of the counting unit 2 are connected to the input system 152 and the power supply line 144 of the power input part 141 of the adjacent accommodating unit 3 so that electric power can be supplied thereto.

On the other hand, even when the power output part 123 of the counting unit 2 is connected to the power input part 141 of the accommodating unit 3 adjacent thereto so that electric power can be supplied thereto, electric power cannot be supplied from the power supply line 124 of the counting unit 2 to the power supply line 144 of the adjacent accommodating unit 3, and electric power cannot also be supplied from the power supply line 125 of the counting unit 2 to the power supply line 143 of the adjacent accommodating unit 3.

Here is described a case where the power output part 142 of one accommodating unit 3 is connected to the power input part 141 of another accommodating unit 3 adjacent thereto on the opposite side of the counting unit 2 so that electric power can be supplied thereto. In such a case, the power supply line 143 and the output system 155 of the power output part 142 of the one accommodating unit 3 are connected to the input system 152 of the power input part 141 and the power supply line 144 of the other accommodating unit 3 so that electric power can be supplied thereto. Also, the power supply line 144 and the output system 156 of the power output part 142 of the one accommodating unit 3 are connected to the input system 151 of the power input part 141 and the power supply line 143 of the other accommodating unit 3 so that electric power can be supplied thereto.

On the other hand, even when the power output part 142 of the one accommodating unit 3 is connected to the power input part 141 of the other accommodating unit 3 so that electric power can be supplied thereto, electric power cannot be supplied from the power supply line 143 of the one accommodating unit 3 to the power supply line 143 of the other accommodating unit 3, and electric power cannot also be supplied from the power supply line 144 of the one accommodating unit 3 to the power supply line 144 of the other accommodating unit 3.

Therefore, when a plurality of accommodating units 3 are connected to the counting unit 2, the one-system internal power supply line 143 having the switch 171 of one accommodating unit 3 forms, together with the one-system internal power supply line 144 having no switch of another adjacent accommodating unit 3 on the downstream side in the banknote transport direction, the same one-system power supply line. The one-system internal power supply line 144 having no switch of the one accommodating unit 3 forms, together with the one-system internal power supply line 143 having the switch 171 of the other adjacent accommodating unit 3 on the downstream side in the banknote transport direction, the same one-system power supply line.

When the control part 32 of the counting unit 2 outputs a control signal to the power control part 173 of one accommodating unit 3, the power control part 173 controls the ON/OFF state of the switch 171 of the one accommodating unit 3. In the one accommodating unit 3, when the switch 171 is brought to the ON state, the power supply line 143 is brought to the ON state. When in the ON state, the power supply line 143 is in the conducting state where electric power from the input system 151 of the power input part 141 can be supplied to the output system 155 of the power output part 142. When the switch 171 is brought to the OFF state, the power supply line 143 is brought to the OFF state. When in the OFF state, the power supply line 143 is in the non-conducting state where electric power from the input system 151 of the power input part 141 cannot be supplied to the output system 155 of the power output part 142.

As a specific example, here is described the paper sheet processing device 1 in which four accommodating units 3 lined up are provided for a single counting unit 2 as shown in FIG. 7. Here, the four accommodating units 3 and configurations thereof are described while reference symbols (A), (B), (C), and (D) are given respectively to them in the order from the side closer to the counting unit 2 in the unit arrangement direction, that is, the banknote transport direction.

The power supply line 124 of the counting unit 2 and the output system 128 of the power output part 123; an input system 151(A) of a power input part 141(A) of an accommodating unit 3 (a first accommodating unit) (A), a power supply line (a third power source supply line) 143(A) and an output system 155(A) of a power output part 142 (A); an input system 152(B) of a power input part 141(B) of an accommodating unit 3 (a second accommodating unit) (B), and a power supply line (a fifth power source supply line) 144(B) and an output system 156(B) of a power output part 142(B); an input system 151(C) of a power input part 141(C) of an accommodating unit (a third accommodating unit) 3(C), and a power supply line (a seventh power source supply line) 143(C) and an output system 155(C) of a power output part 142(C); and an input system 152(D) of a power input part 141(D) of an accommodating unit 3 (an external device, a fourth accommodating unit) (D), and a power supply line 144(D) and an output system 156(D) of a power output part 142(D) are connected to enable supply of electric power, and form one system of a first power supply line 181.

Also, the power supply line 125 of the counting unit 2 and the output system 129 of the power output part 123; an input system 152(A) of the power input part 141(A) of the accommodating unit (the accommodating unit) 3(A), and a power supply line (a fourth power source supply line) 144(A) and an output system 156(A) of the power output part 142(A); an input system 151(B) of the power input part 141(B) of the accommodating unit 3(B), and a power supply line (a sixth power source supply line) 143(B) and an output system 155(B) of a power output part 142(B); an input system 152(C) of the power input part 141(C) of the accommodating unit 3(C), and a power supply line (an eighth power source supply line) 144(C) and an output system 156(C) of a power output part 142(C); and an input system 151(D) of the power input part 141(D) of the accommodating unit 3(D), and a power supply line 143(D) and an output system 155(D) of a power output part 142(D) are connected to enable supply of electric power, and form one system of a second power supply line 182.

In the first power supply line 181, AC/DC conversion parts 172(A), 172(C) of the accommodating units 3(A), 3(C), which are odd-numbered units as counted from the one closest to the counting unit 2 among all of the accommodating units 3(A) to 3(D), are connected, and switches 171(A), 171(C) of the accommodating units 3(A), 3(C) are arranged. In the second power supply line 182, AC/DC conversion parts 172(B), 172(D) of the accommodating units 3(B), 3(D), which are even-numbered units as counted from the one closest to the counting unit 2 among all of the accommodating units 3(A) to 3(D), are connected, and switches 171(B), 171(D) of the accommodating units 3(B), 3(D) are arranged.

Taking an example of the paper sheet processing device 1 in which four accommodating units 3(A) to 3(D) are connected to a single counting unit 2, here are described power-input operation sequences in a case of connecting a plurality of accommodating units 3 to the counting unit 2. Here, two types of operation sequences, a first operation sequence and a second operation sequence, will be described as operation sequences.

"First Operation Sequence"

The first operation sequence is such that after having supplied electric power first to the accommodating units 3(A), 3(C) each having the AC/DC conversion part 172 connected to the first power supply line 181, that is, the accommodating units 3(A), 3(C), which are odd-numbered units as counted from the one closest to the counting unit 2, electric power is supplied to the accommodating units 3(B), 3(D) each having the AC/DC conversion part 172 connected to the second power supply line 182, that is, the accommodating units 3(B), 3(D), which are even-numbered units as counted from the one closest to the counting unit 2. This first operation sequence is an operation sequence for suppressing inrush current.

Figure 8:
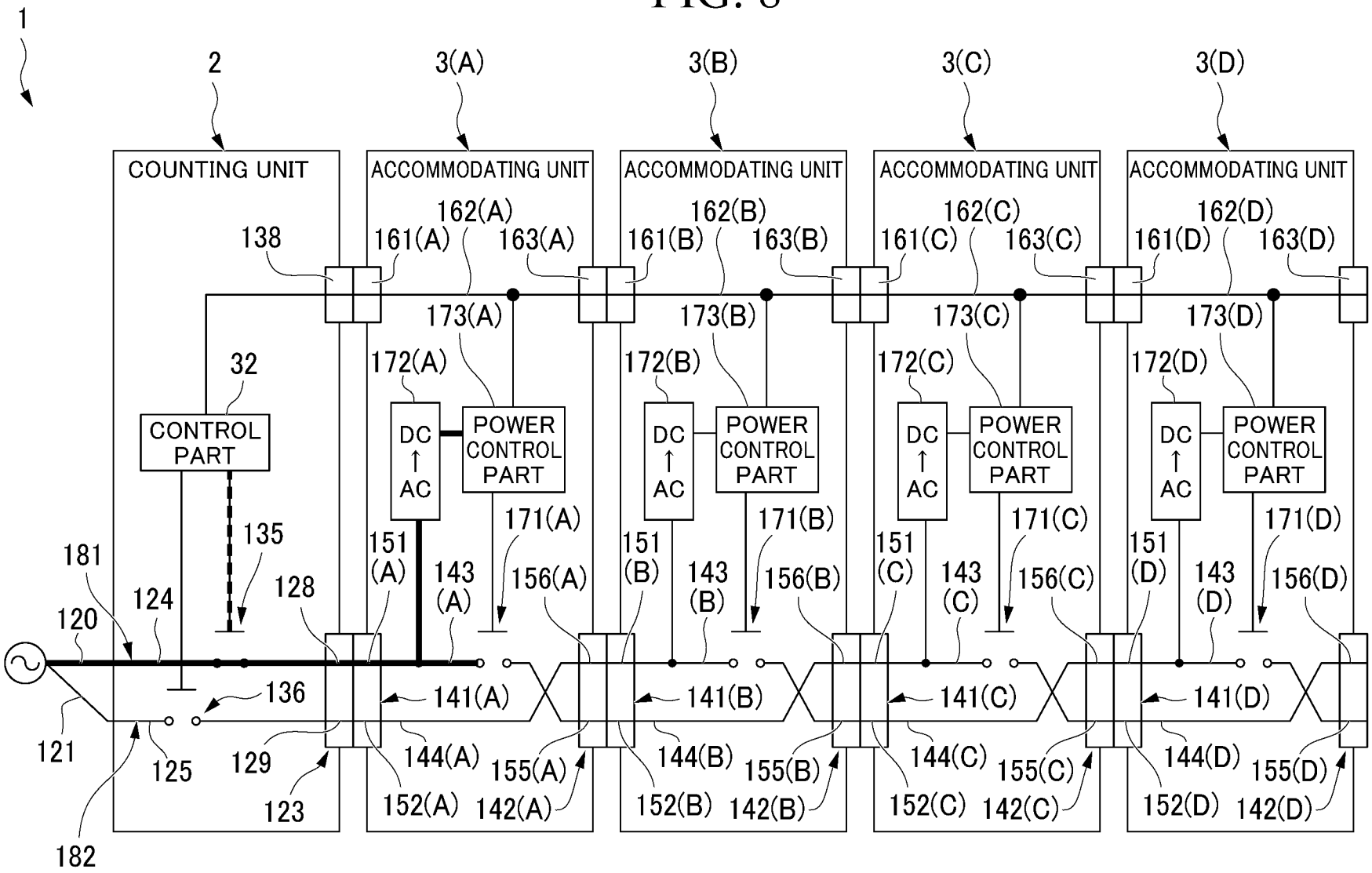
FIG. 8 is a diagram showing the power source system of the one example configuration of the paper sheet processing device according to the first embodiment of the present invention.

First, as shown by the thick broken line in FIG. 8, the control part 32 of the counting unit 2 turns ON the first switch 135 on the power supply line 124 constituting the first power supply line 181. Then, the power supply line 124 is brought into the ON state, and as shown by the thick solid line in FIG. 8, electric power is output to the output system 128 of the power input part 123, resulting in electric power being supplied to the input system 151(A) of the power input part 141(A). As a result, the AC/DC conversion part 172(A) connected to the power supply line 143(A) converts an alternating current into a direct current to be output to the power control part 173(A), thereby activating the power control part 173(A). As a result, electric power is supplied to the accommodating unit 3(A), making it possible to drive the driving components and sensors of the accommodating unit 3(A).

Figure 9:
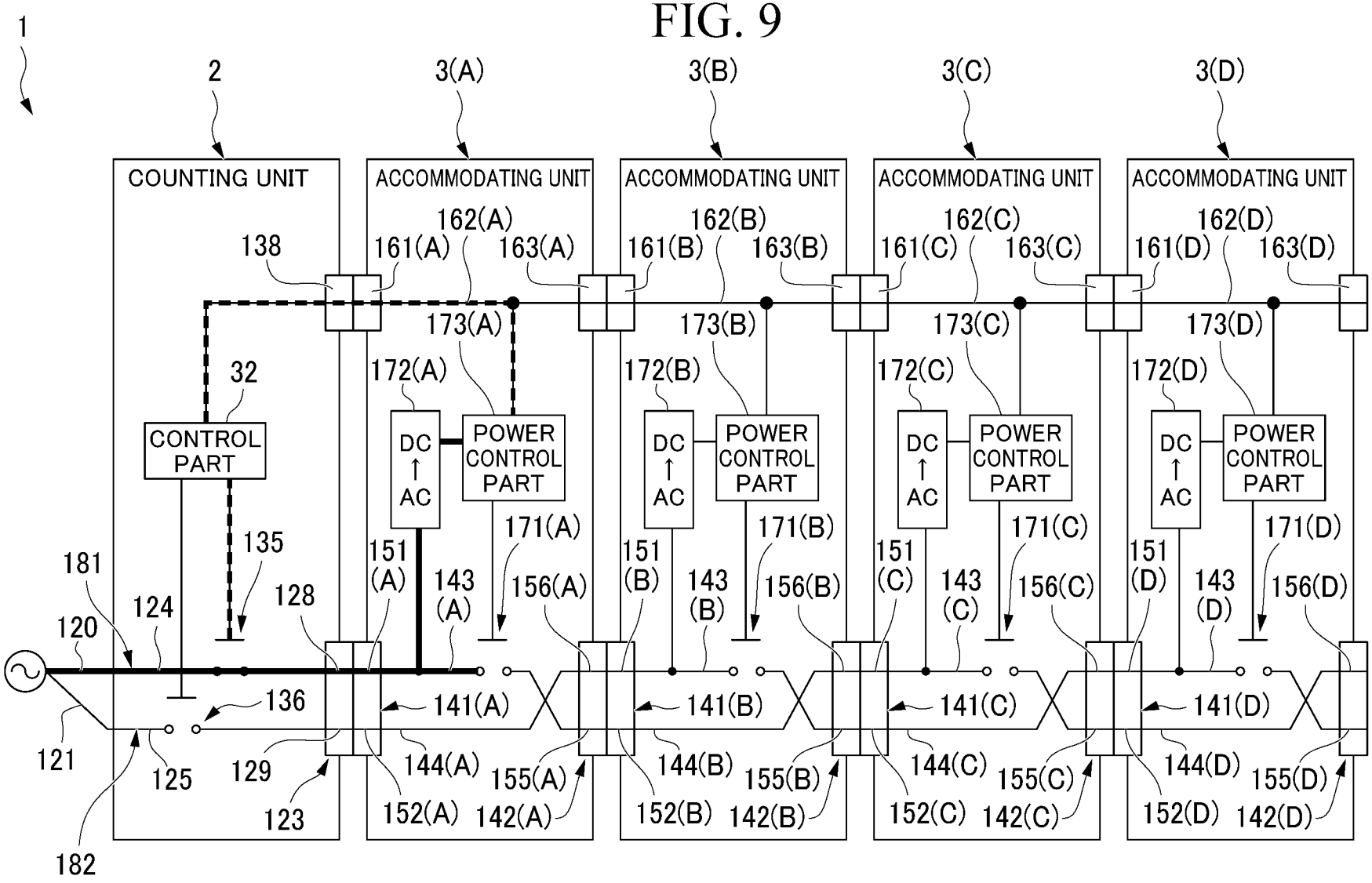
FIG. 9 is a diagram showing a power source system of one example configuration of a paper sheet processing device, which is a first embodiment of a medium processing device according to a first embodiment of the present invention.
Figure 10:
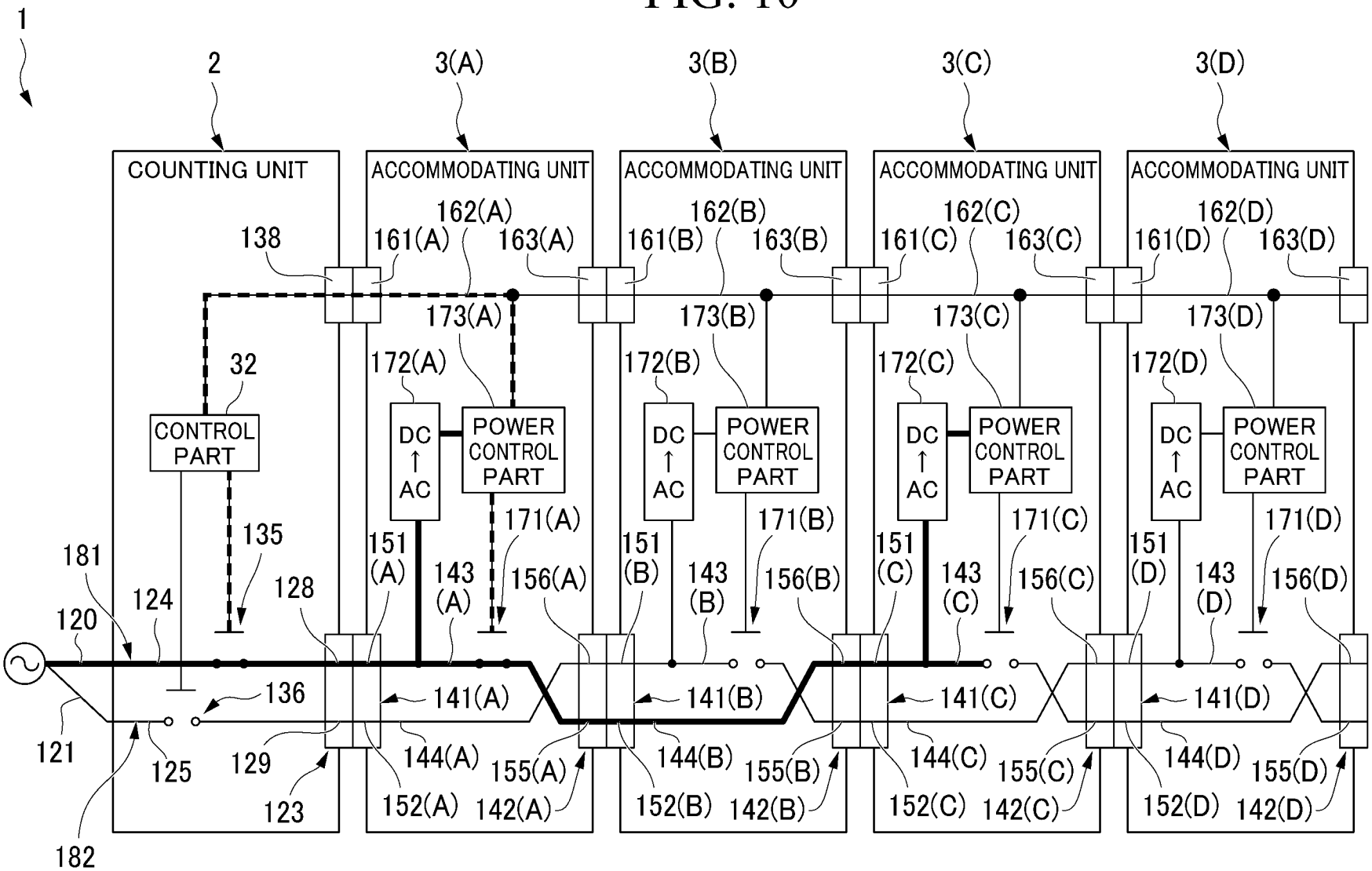
FIG. 10 is a diagram showing the power source system of the one example configuration of a paper sheet processing device, which is the first embodiment of the medium processing device according to the first embodiment of the present invention.

Next, as shown by the thick broken line in FIG. 9, the control part 32 of the counting unit 2 transmits a control signal to the power control part 173(A) of the accommodating unit 3(A) via the I/F output part 138, and the I/F input part 161(A) of the accommodating unit 3(A), and the communication line 162(A), so that the switch 171(A) turns the power supply line 143(A) ON. According to the control signal from the control part 32 of the counting unit 2 on the superordinate side input from the I/F input part 161(A) of the accommodating unit 3(A) in this manner, the power control part 173(A) turns the power supply line 143(A) ON by means of the switch 171(A), supplying electric power to the output system 155(A) of the power output part 142(A) of the accommodating unit 3(A) as shown by the thick solid line in FIG. 10.

Consequently, electric power is supplied to the input system 151(C) of the power input part 141(C) of the accommodating unit 3(C) via the input system 152(B) of the power input part 141(B) of the accommodating unit 3(B), the power supply line 144(B), and the output system 156(B) of the power output part 142(B). As a result, the AC/DC conversion part 172(C) connected to the power supply line 143(C) converts an alternating current into a direct current to be output to the power control part 173(C), thereby activating the power control part 173(C). As a result, electric power is supplied to the accommodating unit 3(C), making it possible to drive the driving components and sensors of the accommodating unit 3(C). In this manner, electric power is supplied to the accommodating units 3(A), 3(C), in which the AC/DC conversion part 172 is connected to the first power supply line 181.

When five or more accommodating units 3 are connected to the counting unit 2, electric power is sequentially input also to the odd-numbered accommodating units 3 after the accommodating unit 3(C) as counted from the one closest to the counting unit 2, in which the AC/DC conversion part 172 is connected to the first power supply line 181, by repeatedly performing control similar to that described above sequentially from the one closest to the counting unit 2.

The control part 32 of the counting unit 2 preliminarily has a grasp of the number of the accommodating units 3 connected to the counting unit 2. Therefore, when it is determined that electric power input to all of the odd-numbered accommodating units 3 as counted from the one closest to the counting unit 2, in which the AC/DC conversion part 172 is connected to the first power supply line 181, has finished, the next step is performed. As the next step, the control part 32 inputs electric power sequentially to the even-numbered accommodating units 3 each having the AC/DC conversion part 172 connected to the second power supply line 182.

Here, even in a case where the control part 32 of the counting unit 2 is not managing the number of the accommodating units 3 connected to the counting unit 2, it is possible to determine that electric power input to the accommodating unit 3 farthest from the counting unit 2 among the odd-numbered accommodating units 3, has finished. For example, in the case where four accommodating units 3(A) to 3(D) are continuously provided for one counting unit 2, the control part 32 outputs a control signal to the accommodating unit 3(C), and when a response from the accommodating unit 3(C) is received, the control part 32 outputs a control signal to the odd-numbered accommodating unit 3 that is the next farthest from the counting unit 2. At this time, if no response to the control signal is returned even after a predetermined length of time has lapsed, the control part 32 determines the accommodating unit 3(C) as being the odd-numbered accommodating unit 3 that is the last from the counting unit 2.

Figure 11:
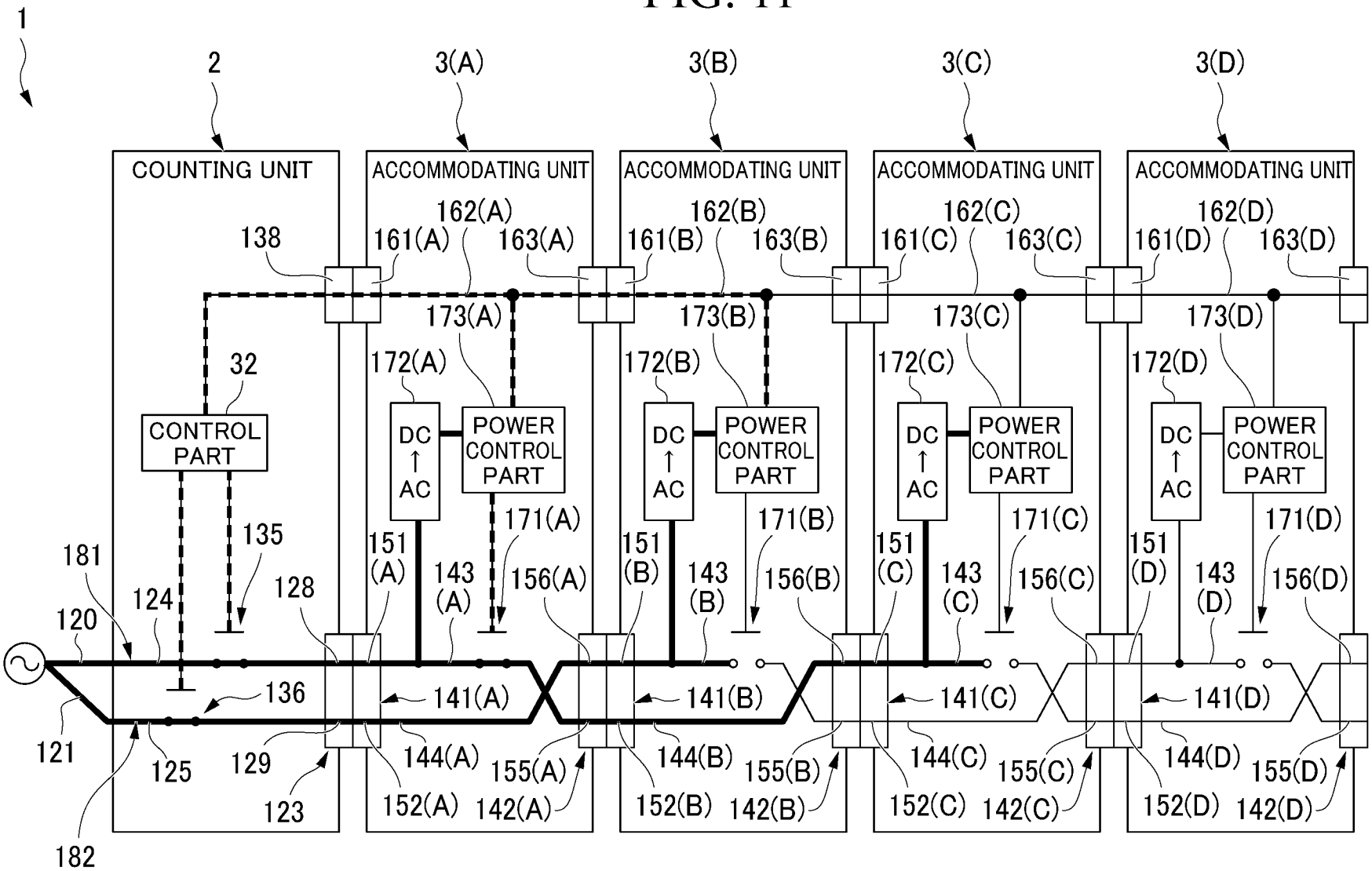
FIG. 11 is a diagram showing the power source system of the one example configuration of a paper sheet processing device, which is the first embodiment of the medium processing device according to the first embodiment of the present invention.

After having supplied electric power to the accommodating units 3(A), 3(C), in which the AC/DC conversion part 172 is connected to the first power supply line 181, in the manner described above, the control part 32 of the counting unit 2, as shown by the thick broken line in FIG. 11, turns ON the second switch 136 on the power supply line 125 constituting the second power supply line 182, thereby bringing the power supply line 125 into the ON state. Consequently, as shown by the thick solid line in FIG. 11, electric power is output to the output system 129 of the power output part 123, and electric power is supplied to the input system 151(B) of the power input part 141(B) of the accommodating unit 3(B) via the input system 152(A) of the power input part 141(A) of the accommodating unit 3(A), the power supply line 144(A), and the output system 156(A) of the power output part 142(A). As a result, the AC/DC conversion part 172(B) connected to the power supply line 143(B) within the accommodating unit 3(B) converts an alternating current into a direct current to be output to the power control part 173(B), thereby activating the power control part 173(B). As a result, electric power is supplied to the accommodating unit 3(B), making it possible to drive the driving components and sensors of the accommodating unit 3(B).

Figure 12:
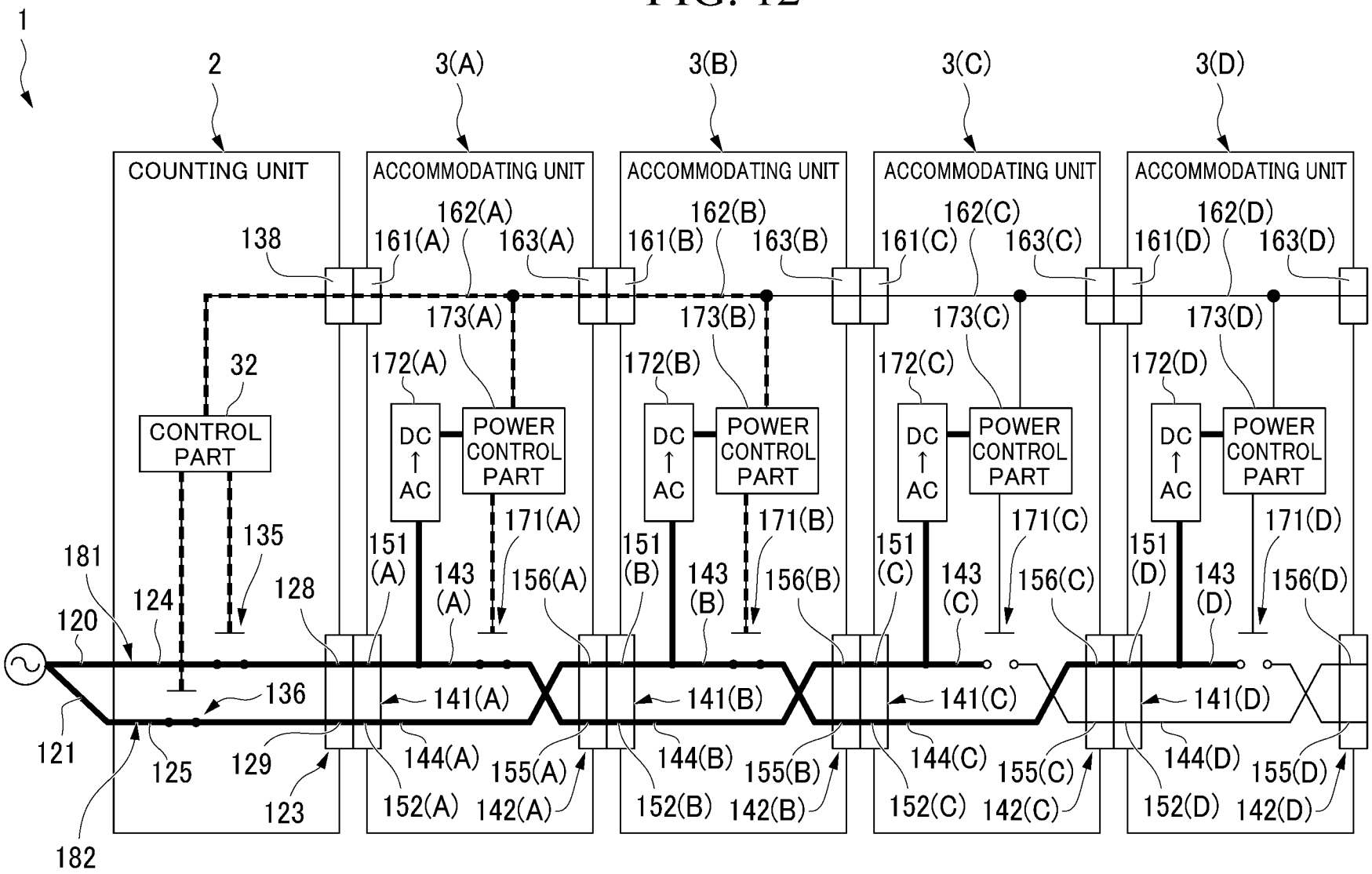
FIG. 12 is a diagram showing the power source system of the one example configuration of a paper sheet processing device, which is the first embodiment of the medium processing device according to the first embodiment of the present invention.

Next, as shown by the thick broken line in FIG. 12, the control part 32 of the counting unit 2 transmits a control signal to the power control part 173(B) of the accommodating unit 3(B) via the I/F output part 138, the I/F input part 161(A) of the accommodating unit 3(A), the communication line 162(A), the I/F output part 163(A), the I/F input part 161(B) of the accommodating unit 3(B), and the communication line 162(B), so that the switch 171(B) turns the power supply line 143(B) ON. According to the control signal from the control part 32 of the counting unit 2 on the superordinate side input from the I/F input part 161(B) of the accommodating unit 3(B) in this manner, the power control part 173(B) turns the power supply line 143(B) ON by means of the switch 171(B), supplying electric power to the output system 155(B) of the power output part 142(B) of the accommodating unit 3(B) as shown by the thick broken line in FIG. 12.

Consequently, electric power is supplied to the input system 151(D) of the power input part 141(D) of the accommodating unit 3(D) via the input system 152(C) of the power input part 141(C) of the accommodating unit 3(C), the power supply line 144(C), and the output system 156(C) of the power output part 142(C). As a result, the AC/DC conversion part 172(D) connected to the power supply line 143(D) within the accommodating unit 3(D) converts an alternating current into a direct current to be output to the power control part 173(D), thereby activating the power control part 173(D). As a result, electric power is supplied to the accommodating unit 3(D), making it possible to drive the driving components and sensors of the accommodating unit 3(D). In this manner, electric power is supplied to the accommodating units 3(B), 3(D), in which the AC/DC conversion part 172 is connected to the second power supply line 182.

When six or more accommodating units 3 are connected to the counting unit 2, electric power is sequentially input also to the even-numbered accommodating units 3 having the AC/DC conversion part 172 connected to the second power supply line 182 after the accommodating unit 3(D) as counted from the one closest to the counting unit 2, by repeatedly performing control similar to that described above sequentially from the one closest to the counting unit 2.

As a result of the above, input of electric power to all of the accommodating units 3(A), 3(C), in which the AC/DC conversion part 172 is connected to the first power supply line 181, and to all of the accommodating units 3(B), 3(D), in which the AC/DC conversion part 172 is connected to the second power supply line 182, is finished.

The control part 32 of the counting unit 2 preliminarily has a grasp of the number of the accommodating units 3 connected to the counting unit 2. Therefore, when input of electric power to all of the accommodating units 3 in which the AC/DC conversion part 172 is connected to the second power supply line 182 is determined as having been finished, the control part 32 determines that input of electric power to all of the accommodating units 3 in which the AC/DC conversion part 172 is connected to the first power supply line 181 and input of electric power to all of the accommodating units 3 in which the AC/DC conversion part 172 is connected to the second power supply line 182, is finished. That is to say, the control part 32 determines that input of electric power to all of the accommodating units 3 that receive supply of electric power via the counting unit 2 has been finished.

Here, even in a case where the control part 32 of the counting unit 2 is not managing the number of the accommodating units 3 connected to the counting unit 2, it is possible to determine that electric power input to the accommodating unit 3 farthest from the counting unit 2 among the even-numbered accommodating units 3, has finished. For example, in the case where four accommodating units 3(A) to 3(D) are continuously provided for one counting unit 2, the control part 32 outputs a control signal to the accommodating unit 3(D), and when a response from the accommodating unit 3(D) is received, the control part 32 outputs a control signal to the even-numbered accommodating unit 3 that is the next farthest from the counting unit 2. At this time, if no response to the control signal is returned even after a predetermined length of time has lapsed, the accommodating unit 3(D) is determined as being the even-numbered accommodating unit 3 that is the last from the counting unit 2.

As described above, in the first operation sequence, the timing of supplying electric power to each of the plurality of accommodating units 3 is shifted by the communication control of the control part 32 of the counting unit 2. That is to say, in the first operation sequence, after all of the switches 171 of the first power supply line 181 have been turned ON one by one, the switches 171 of the second power supply line 182 are turned ON one by one. This enables suppression of inrush current when input of electric power is performed.

On the basis of a control signal from the counting unit 2, the power control part 173 of the accommodating unit 3, by means of the switch 171, turns ON or OFF the power supply line 143, which is one system among the two systems of the internal power supply line 143 and the power supply line 144.

"Second Operation Sequence"

In the second operation sequence, in parallel with supplying electric power to the accommodating units 3(A) having the AC/DC conversion part 172 connected to the first power supply line 181, which is the smallest-odd-numbered (first) unit as counted from the one closest to the counting unit 2, electric power is supplied to the accommodating unit 3(B) having the AC/DC conversion part 172 connected to the second power supply line 182, which is the smallest-even-numbered (second) unit as counted from the one closest to the counting unit 2. Then, in parallel with supplying electric power to the accommodating unit 3(C) having the AC/DC conversion part 172 connected to the first power supply line 181, which is the next smallest-odd-numbered (third) unit, electric power is supplied to the accommodating unit 3(D) having the AC/DC conversion part 172 connected to the second power supply line 182, which is the next smallest-even-numbered (fourth) unit.

Figure 13:
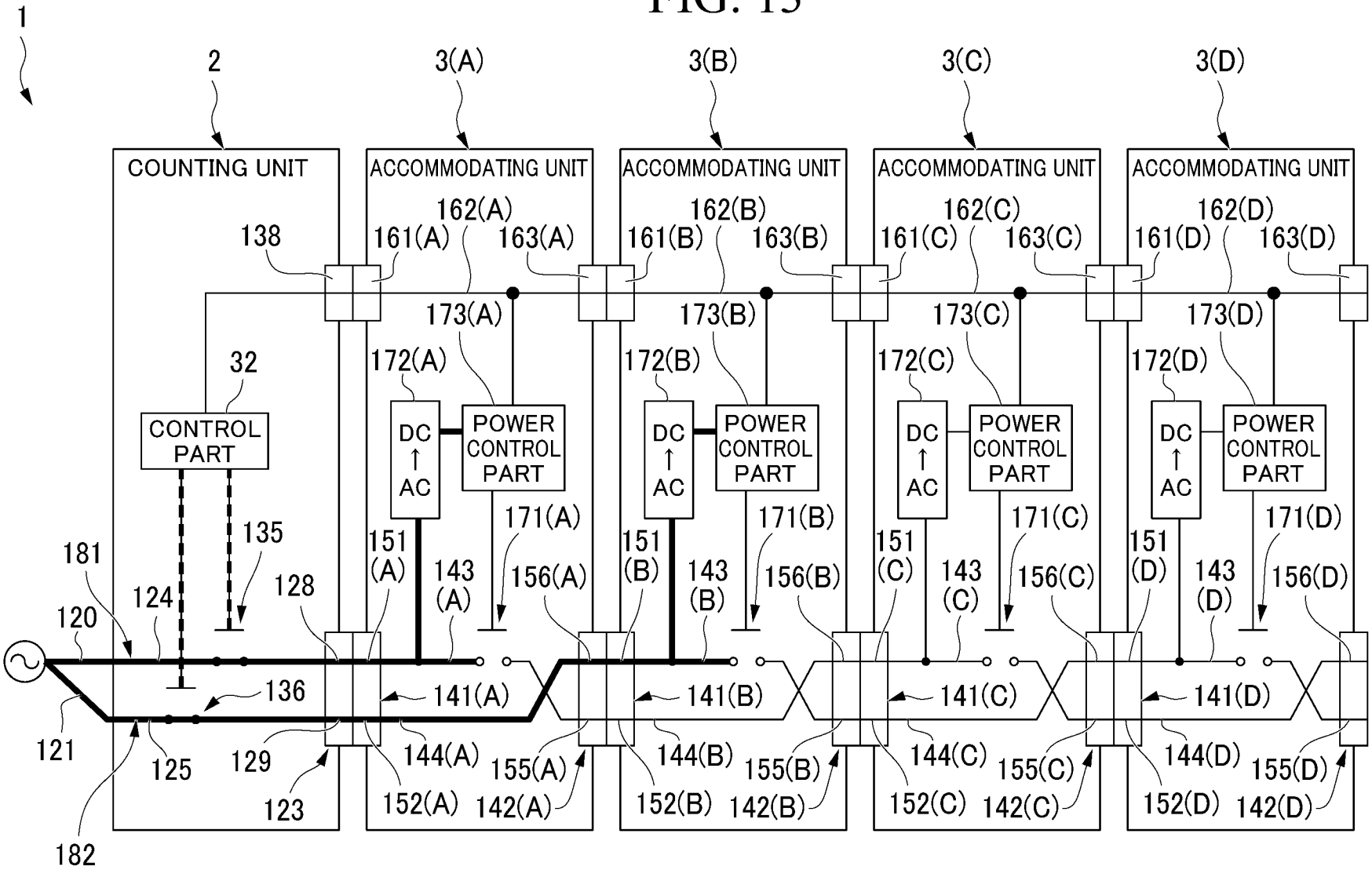
FIG. 13 is a diagram showing the power source system of the one example configuration of a paper sheet processing device, which is the first embodiment of the medium processing device according to the first embodiment of the present invention.

First, when, as shown by the thick broken line in FIG. 13, the control part 32 of the counting unit 2 turns ON the first switch 135 on the power supply line 124 constituting the first power supply line 181, and in parallel with this, the second switch 136 on the power supply line 125 constituting the second power supply line 182 is turned ON, then, as shown by the thick solid line in FIG. 13, electric power is output to the output system 128 and the output system 129 of the power output part 123.

Then, meanwhile, the AC/DC conversion part 172(A) connected to the power supply line 143(A) within the accommodating unit 3(A) converts an alternating current into a direct current to be output to the power control part 173(A), thereby activating the power control part 173(A). At this time, electric power is supplied to the accommodating unit 3(A), making it possible to drive the driving components and sensors of the accommodating unit 3(A). On the other hand, the AC/DC conversion part 172(B) connected to the power supply line 144(A) in the accommodating unit 3(A) and the power supply line 143(B) in the accommodating unit 3(B) converts an alternating current into a direct current to be output to the power control part 173(B), thereby activating the power control part 173(B). At this time, electric power is supplied to the accommodating unit 3(B), making it possible to drive the driving components and sensors of the accommodating unit 3(B).

Figure 14:
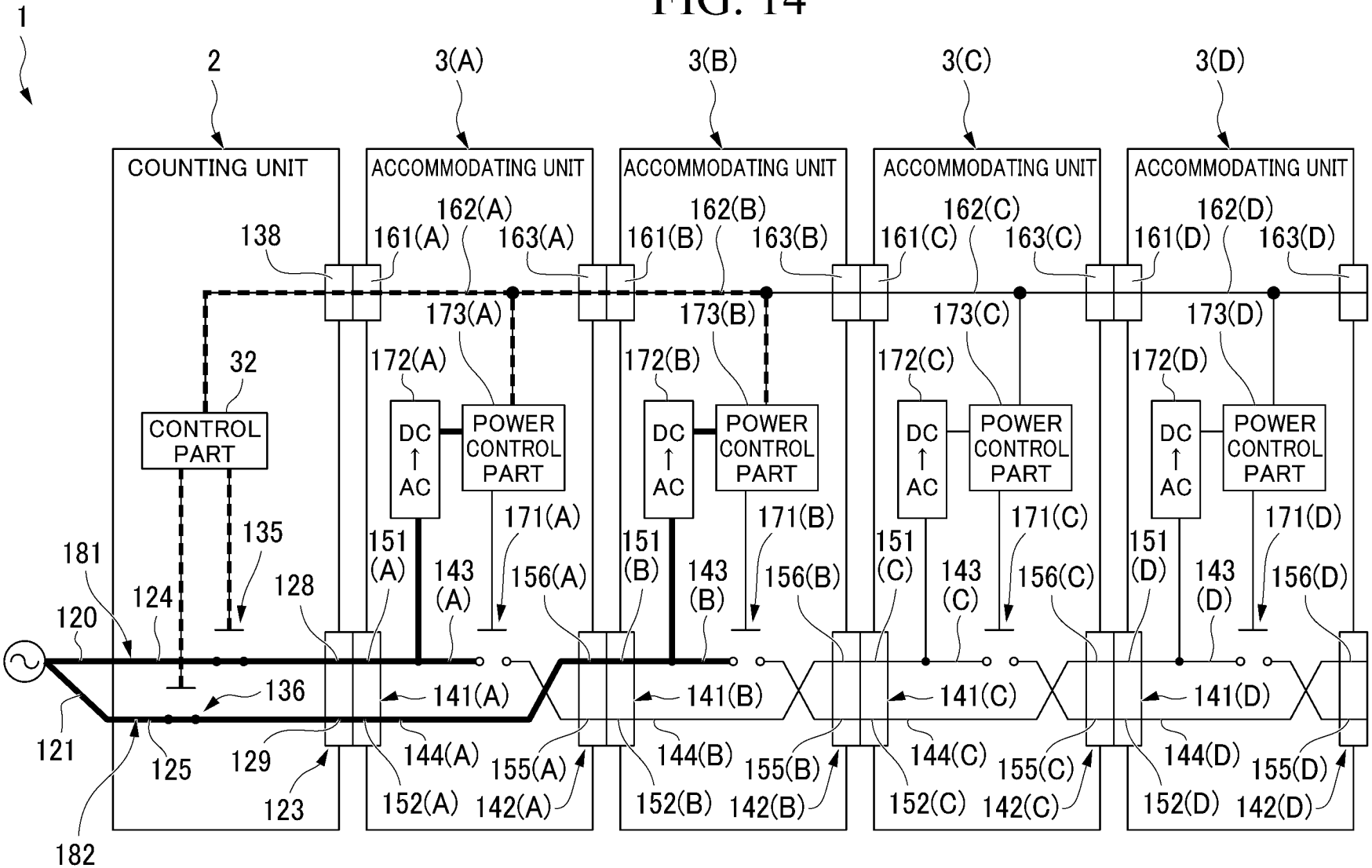
FIG. 14 is a diagram showing the power source system of the one example configuration of a paper sheet processing device, which is the first embodiment of the medium processing device according to the first embodiment of the present invention.

Next, as shown in FIG. 14, the control part 32 of the counting unit 2 transmits a control signal to the power control part 173(A) of the accommodating unit 3(A) via the I/F output part 138, and the I/F input part 161(A) of the accommodating unit 3(A), and the communication line 162(A), so that the switch 171(A) turns the power supply line 143(A) ON. In parallel with this, the control part 32 transmits a control signal to the power control part 173(B) of the accommodating unit 3(B) via the I/F output part 138, the I/F input part 161(A) of the accommodating unit 3(A), the communication line 162(A), the I/F output part 163(A), the I/F input part 161(B) of the accommodating unit 3(B), and the communication line 162(B), so that the switch 171(B) turns the power supply line 143(B) ON.

Figure 15:
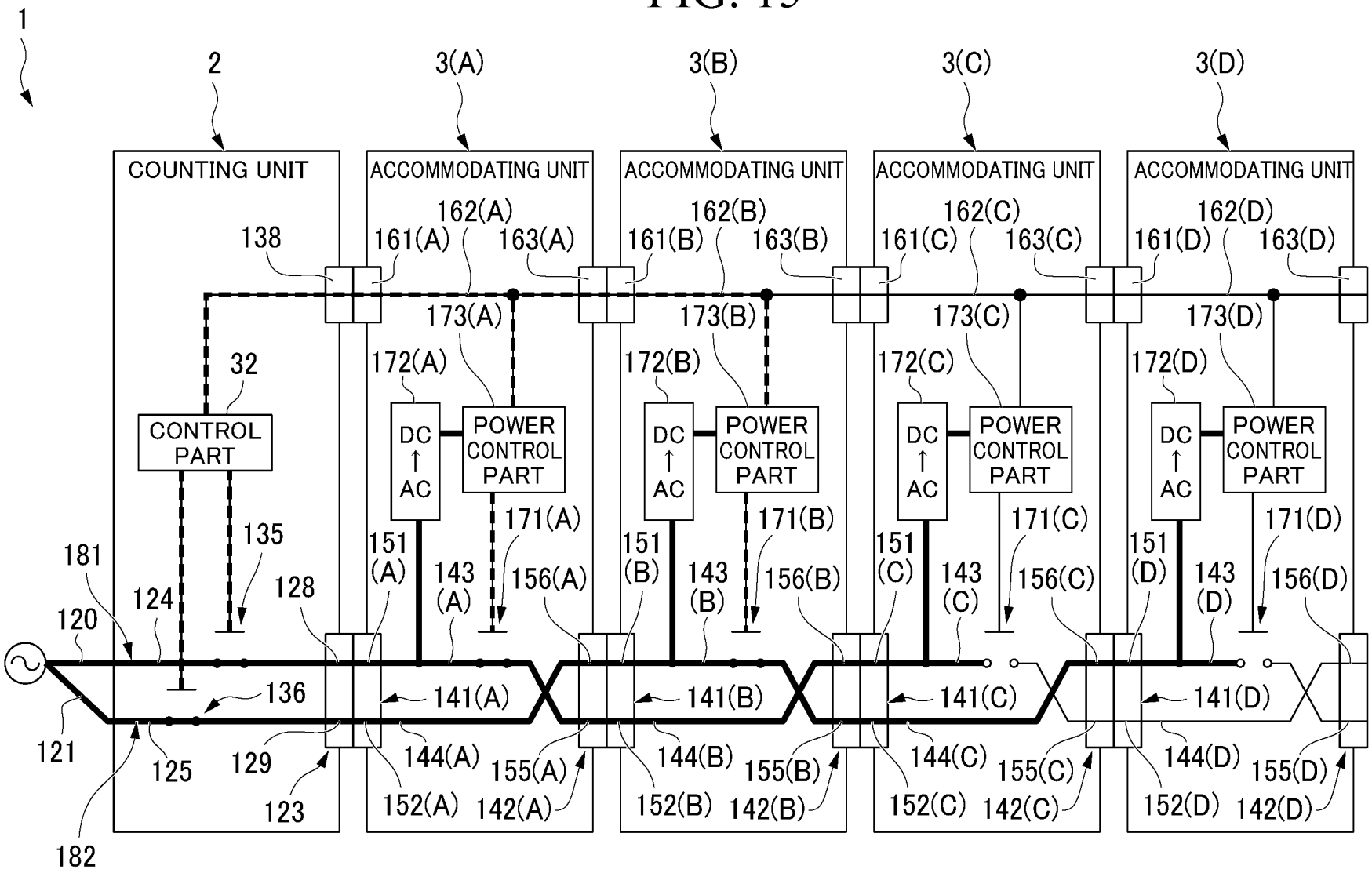
FIG. 15 is a diagram showing the power source system of the one example configuration of a paper sheet processing device, which is the first embodiment of the medium processing device according to the first embodiment of the present invention.

Upon receiving such a control signal from the control part 32, then according to the control signal from the control part 32 of the counting unit 2 on the superordinate side input from the I/F input part 161(A) of the accommodating unit 3(A), the power control part 173(A) of the accommodating unit 3(A) turns the power supply line 143(A) ON by means of the switch 171(A), as shown by the thick solid line in FIG. 15, supplying electric power to the output system 155(A) of the power output part 142(A) of the accommodating unit 3(A).

Consequently, electric power is supplied to the input system 152(B) of the power input part 141(B) of the accommodating unit 3(B), the power supply line 144(B), the output system 156(B) of the power output part 142(B), and the input system 151(C) of the power input part 141(C) of the accommodating unit 3(C). As a result, the AC/DC conversion part 172(C) connected to the input system 151(C) of the power input part 141(C) in the accommodating unit 3(C) and the power supply line 143(C) converts an alternating current into a direct current to be output to the power control part 173(C), thereby activating the power control part 173(C). At this time, electric power is supplied to the accommodating unit 3(C), making it possible to drive the driving components and sensors of the accommodating unit 3(C).

Upon receiving a control signal from the control part 32, then according to the control signal from the control part 32 of the counting unit 2 on the superordinate side input from the I/F input part 161(B) of the accommodating unit 3(B), the power control part 173(B) of the accommodating unit 3(B) turns the power supply line 143(B) ON by means of the switch 171(B), supplying electric power to the output system 155(B) of the power output part 142(B) of the accommodating unit 3(B).

Consequently, electric power is supplied to the input system 151(D) of the power input part 141(D) of the accommodating unit 3(D) via the input system 152(C) of the power input part 141(C) of the accommodating unit 3(C), the power supply line 144(C), and the output system 156(C) of the power output part 142(C). As a result, the AC/DC conversion part 172(D) connected to the input system 151(D) of the power input part 141(D) and the power supply line 143(D) converts an alternating current into a direct current to be output to the power control part 173(D), thereby activating the power control part 173(D). At this time, electric power is supplied to the accommodating unit 3(D), making it possible to drive the driving components and sensors of the accommodating unit 3(D).

When five or more accommodating units 3 are connected to the counting unit 2, electric power is sequentially input also to the odd-numbered accommodating units 3 after the accommodating unit 3(C) as counted from the one closest to the counting unit 2, in which the AC/DC conversion part 172 is connected to the first power supply line 181, and to the even-numbered accommodating units 3 after the accommodating unit 3(D) as counted from the one closest to the counting unit 2, in which the AC/DC conversion part 172 is connected to the second power supply line 182, by repeatedly performing control similar to that described above sequentially from the one closest to the counting unit 2.

As a result of the above, input of electric power to all of the accommodating units 3(A), 3(C), in which the AC/DC conversion part 172 is connected to the first power supply line 181, and to all of the accommodating units 3(B), 3(D), in which the AC/DC conversion part 172 is connected to the second power supply line 182, is finished.

Therefore, the power input part 141 of the accommodating unit 3 receives input of electric power from the two systems of the power supply line 124 and the power supply line 125 in the counting unit 2 adjacent to each other on the upstream side in the power supply direction thereof, or from the two systems of the power supply line 143 and the power supply line 144 in another accommodating unit 3 adjacent to each other on the upstream side in the power supply direction thereof. The power supply line 143 and the power supply line 144 within the accommodating unit 3 are connected to this power input part 141. The power output part 142 is connected to the two systems of the internal power supply line 143 and power supply line 144, and can output electric power through the two systems of the power supply line 143 and the power supply line 144, toward the accommodating unit 3 arranged on the downstream side in the paper sheet transport direction.

According to the paper sheet processing device 1 of the first embodiment described above, the accommodating unit 3 is supplied with electric power from the counting unit 2 through two systems of the power supply line 124 and the power supply line 125. Electric power supplied through these two systems of the power supply line 124 and the power supply line 125 is controlled by control signals output from the I/F output part 138 of the counting unit 2. Therefore, it is possible to suppress the maximum rated current per system of the power supply line 124 and the power supply line 125. Therefore, it is possible to suppress an increase in cost.

On the basis of a control signal from the counting unit 2, the power control part 173 of the accommodating unit 3 turns, by means of the switch 171, ON or OFF the power supply line 143, which is one system among the two systems of the internal power supply line 143 and power supply line 144. As a result, the timing of supplying electric power can be controlled (shifted) by means of communication control from the counting unit 2. This enables suppression of inrush current when input of electric power is performed.

Moreover, the one-system internal power supply line 143 having the switch 171 of one accommodating unit 3 forms, together with the one-system internal power supply line 144 having no switch of another adjacent accommodating unit 3 on the downstream side in the banknote transport direction, the same one-system first power supply line 181. Also, the one-system internal power supply line 144 having no switch of the one accommodating unit 3 forms, together with the one-system internal power supply line 143 having the switch 171 of the other adjacent accommodating unit 3 on the downstream side in the banknote transport direction, the same one-system second power supply line 182. As a result, it is possible, with a simple structure, to supply electric power to the one accommodating unit 3 and to the other accommodating unit 3 at different timings. Therefore, it is possible to further suppress an increase in cost.

Furthermore, in the first operation sequence, after all of the switches 171 of the first power supply line 181 have been turned ON, the switches 171 of the second power supply line 182 are turned ON. Therefore, it is possible to suppress the maximum rated current per system of the first power supply line 181 and the second power supply line 182. Therefore, it is possible to suppress an increase in cost.

Moreover, even in a case where a plurality of accommodating units 3 are additionally provided, it is not necessary to change the configuration of the counting unit 2 according to the number of accommodating units 3. Therefore, the paper sheet processing device 1 can be constructed at low cost. Also, the accommodating unit 3 is commonalized, so that variations can be easily increased.

Moreover, even in the case of additionally providing the accommodating units 3, the paper sheet processing device 1 can be constructed safely and inexpensively by simply adding the completely same accommodating units 3.

Normally, through the first operation sequence, electric power is supplied alternately to the two systems of the first power supply line 181 and the second power supply line 182. In a case where electric power supplied from the counting unit 2 is expected to be more than sufficient, it is possible to reduce the amount of time required to complete supplying electric power to all of the accommodating units 3 by simultaneously supplying electric power to the two systems of the first power supply line 181 and the second power supply line 182 through the second operation sequence.

Second Embodiment

Hereunder, a paper sheet processing device according to a second embodiment of the present invention will be described with reference primarily to FIG. 16, focusing on the differences from the first embodiment.

In the first embodiment, the counting unit 2 has two systems of power supply lines 124, 125. Moreover, in the first embodiment, the accommodating unit 3 has: the power input part 141 to which electric power is input from the two systems of power supply lines 124, 125; the two systems of internal power supply lines 143, 144; the power output part 142 that can output electric power by means of the two systems of power supply lines 143, 144; and the power control part 173 that, by means of the switch 171, turns ON or OFF the internal power supply line 143, which is one of the two systems of the internal power supply lines 143, 144, on the basis of the control signal from the counting unit 2. Furthermore, in the first embodiment, the paper sheet processing device 1 has two systems of the first power supply line 181 and the second power supply line 182.

However, it is sufficient that the counting unit 2 has at least two systems of power supply lines, and the embodiment of the present invention is not limited to the above configuration. Moreover, it is sufficient that the accommodating unit 3 has: a power input part to which electric power is input from at least two systems of power supply lines; at least two systems of internal power supply lines; a power output part that can output electric power by means of at least two systems of power supply lines; and a power control part that, by means of a switch, controls the ON/OFF state of one of at least two systems of internal power supply lines, on the basis of a control signal from the counting unit 2, and the embodiment of the present invention is not limited to the above configuration. Furthermore, it is sufficient that the paper sheet processing device 1 has at least two systems of power supply lines, and the embodiment of the present invention is not limited to the above configuration.

A paper sheet processing device 1 according to the second embodiment has a third power supply line 183 in addition to the first power supply line 181 and the second power supply line 182. Accordingly, the counting unit 2 has a third power connection part 122 in addition to the first power connection part 120 and the second power connection part 121. In addition to the power supply line 124 and the power supply line 125, the counting unit 2 includes a power supply line 126 connected to the third power connection part 122 and having a third switch 137. The power output part 123 has an output system 130 connected to the power supply line 126, in addition to the output system 128 and the output system 129.

Moreover, in addition to the power supply line 143 and the power supply line 144, the accommodating unit 3 has a power supply line 145. In addition to the input system 151 and the input system 152, the power input part 141 has an input system 153. In addition to the input system 155 and the input system 156, the power output part 142 has an output system 157. The input system 153 and the input system 157 are connected to the power supply line 145. The same applies to the case where the paper sheet processing device 1 has four or more power supply lines.

Figure 16:
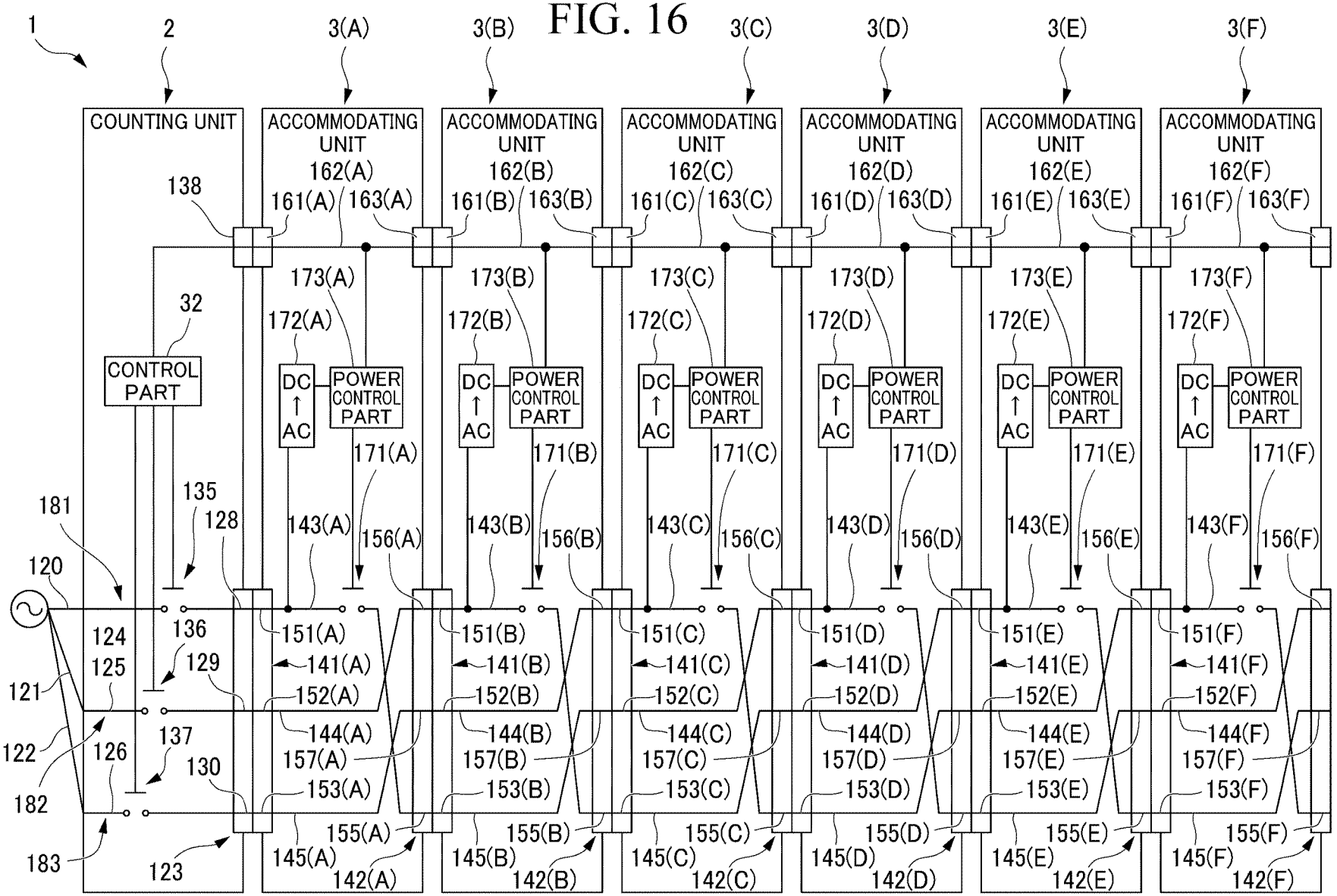
FIG. 16 is a diagram showing a power source system of one example configuration of a paper sheet processing device, which is a second embodiment of a medium processing device according to a second embodiment of the present invention.

As the second embodiment, here is described, as a specific example, the paper sheet processing device 1 in which six accommodating units 3 are provided lined up for a single counting unit 2, as shown in FIG. 16. Here, the six accommodating units 3 and configurations thereof are described while reference symbols (A), (B), (C), and (D) are given respectively to them in the order from the side closer to the counting unit 2 in the banknote transport direction.

The first power supply line 181 that receives supply of electric power from the first power connection part 120 is constituted from: a power supply line 124; an output system 128 of a power output part 123; an input system 151(A) of a power input part 141(A); a power supply line 143(A); an output system 155(A) of a power output part 142(A); an input system 153(B) of a power input part 141(B); a power supply line 145(B); an output system 157(B) of a power output part 142(B); an input system 152(C) of a power input part 141(C); a power supply line 144(C); an output system 156(C) of a power output part 142(C); an input system 151(D) of a power input part 141(D); a power supply line 143(D); an output system 155(D) of a power output part 142(D); an input system 153(E) of a power input part 141(E); a power supply line 145(E); an output system 157(E) of a power output part 142(E); an input system 152(F) of a power input part 141(F); a power supply line 144(F); and an output system 156(F) of a power output part 142(F).

The second power supply line 182 that receives supply of electric power from the second power connection part 121 is constituted from: a power supply line 125; an output system 129 of the power output part 123; an input system 152(A) of the power input part 141(A); a power supply line 144(A); an output system 156(A) of the power output part 142(A); an input system 151(B) of the power input part 141(B); a power supply line 143(B); an output system 155(B) of the power output part 142(B); an input system 153(C) of the power input part 141(C); a power supply line 145(C); an output system 157(C) of the power output part 142(C); an input system 152(D) of the power input part 141(D); a power supply line 144(D); an output system 156(D) of the power output part 142(D); an input system 151(E) of the power input part 141(E); a power supply line 143(E); an output system 155(E) of the power output part 142(E); an input system 153(F) of the power input part 141(F); a power supply line 145(F); and an output system 157(F) of the power output part 142(F).

The third power supply line 183 that receives supply of electric power from the third power connection part 122 is constitute from: a power supply line 126; an output system 130 of the power output part 123; an input system 153(A) of the power input part 141(A); a power supply line 145(A); an output system 157(A) of the power output part 142(A); an input system 152(B) of the power input part 141(B); a power supply line 144(B); an output system 156(B) of the power output part 142(B); an input system 151(C) of the power input part 141(C); a power supply line 143(C); an output system 155(C) of the power output part 142(C); an input system 153(D) of the power input part 141(D); a power supply line 145(D); an output system 157(D) of the power output part 142(D); an input system 152(E) of the power input part 141(E); a power supply line 144(E); an output system 156(E) of the power output part 142(E); an input system 151(F) of the power input part 141(F); a power supply line 143(F); and an output system 155(F) of the power output part 142(F).

"First Operation Sequence"

The first operation sequence is such that electric power is supplied to the accommodating units 3(A), 3(D) in which the AC/DC conversion part 172 is connected to the first power supply line 181; then, electric power is supplied to the accommodating units 3(B), 3(E) in which the AC/DC conversion part 172 is connected to the second power supply line 182; and then, electric power is supplied to the accommodating units 3(C), 3(F) in which the AC/DC conversion part 172 is connected to the third power supply line 183. This first operation sequence is an operation sequence for suppressing inrush current.

First, when the control part 32 of the counting unit 2 turns ON the first switch 135 on the power supply line 124, the AC/DC conversion part 172(A) connected to the power supply line 143(A) of the accommodating unit 3(A) converts an alternating current into a direct current to be output to the power control part 173(A), thereby activating the power control part 173(A). At this time, electric power is supplied to the accommodating unit 3(A), making it possible to drive the driving components and sensors of the accommodating unit 3(A).

Next, the control part 32 of the counting unit 2 transmits a control signal to the power control part 173(A) of the accommodating unit 3(A) so that the switch 171(A) turns the power supply line 143(A) ON, and upon receiving this control signal, the power control part 173(A) causes the switch 171(A) to turn the power supply line 143(A) ON.

Then, electric power (alternating current) is supplied from the power supply line 143(A) of the accommodating unit 3(A) to the AC/DC conversion part 172(D) of the accommodating unit 3(D) via the power supply line 145(B) of the accommodating unit 3(B), the power supply line 144(C) of the accommodating unit 3(C), and the power supply line 143(D) of the accommodating unit 3(D). The AC/DC conversion part 172(D) converts the alternating current into a direct current to be output to the power control part 173(D), thereby activating the power control part 173(D). At this time, electric power is supplied to the accommodating unit 3(D), making it possible to drive the driving components and sensors of the accommodating unit 3(D). Thus, electric power is supplied to the accommodating units 3(A), 3(D), in which the AC/DC conversion part 172 is connected to the first power supply line 181.

After having supplied electric power to the accommodating units 3(A), 3(D), in which the AC/DC conversion part 172 is connected to the first power supply line 181, in the manner described above, the control part 32 of the counting unit 2 turns ON the second switch 136 on the power supply line 125. Thereby, electric power (alternating current) is supplied from the power supply line 143(B) to the AC/DC conversion part 172(B) via the power supply line 144(A) of the accommodating unit 3(A). The AC/DC conversion part 172(B) converts the alternating current into a direct current to be output to the power control part 173(B), thereby activating the power control part 173(B). At this time, electric power is supplied to the accommodating unit 3(B), making it possible to drive the driving components and sensors of the accommodating unit 3(B).

Next, the control part 32 of the counting unit 2 transmits a control signal to the power control part 173(B) of the accommodating unit 3(B) so that the switch 171(B) turns the power supply line 143(B) ON. Upon receiving this control signal, the power control part 173(B) causes the switch 171(B) to turn the power supply line 143(B) ON.

Then, electric power (alternating current) is supplied from the power supply line 143(B) of the accommodating unit 3(B) to the AC/DC conversion part 172(E) of the accommodating unit 3(E) via the power supply line 145(C) of the accommodating unit 3(C), the power supply line 144(D) of the accommodating unit 3(D), and the power supply line 143(E) of the accommodating unit 3(E). The AC/DC conversion part 172(E) converts the alternating current into a direct current to be output to the power control part 173(E), thereby activating the power control part 173(E). At this time, electric power is supplied to the accommodating unit 3(E), making it possible to drive the driving components and sensors of the accommodating unit 3(E). Thus, electric power is supplied to the accommodating units 3(B), 3(E), in which the AC/DC conversion part 172 is connected to the second power supply line 182.

After having supplied electric power to the accommodating units 3(B), 3(E), in which the AC/DC conversion part 172 is connected to the second power supply line 182, in the manner described above, the control part 32 of the counting unit 2 turns ON the third switch 137 on the power supply line 126. Then, electric power (alternating current) is supplied to the AC/DC conversion part 172(C) of the accommodating unit 3(C) via the power supply line 145(A) of the accommodating unit 3(A), the power supply line 144(B) of the accommodating unit 3(B), and the power supply line 143(C) of the accommodating unit 3(C). The AC/DC conversion part 172(C) converts the alternating current into a direct current to be output to the power control part 173(C), thereby activating the power control part 173(C). At this time, electric power is supplied to the accommodating unit 3(C), making it possible to drive the driving components and sensors of the accommodating unit 3(C).

Next, the control part 32 of the counting unit 2 transmits a control signal to the power control part 173(C) of the accommodating unit 3(C) so that the switch 171(C) turns the power supply line 143(C) ON. Upon receiving this control signal, the power control part 173(C) causes the switch 171(C) to turn the power supply line 143(C) ON.

Then, electric power (alternating current) is supplied from the power supply line 143(C) of the accommodating unit 3(C) to the AC/DC conversion part 172(F) of the accommodating unit 3(F) via the power supply line 145(D) of the accommodating unit 3(D), the power supply line 144(E) of the accommodating unit 3(E), and the power supply line 143(F) of the accommodating unit 3(F). The AC/DC conversion part 172(F) converts the alternating current into a direct current to be output to the power control part 173(F), thereby activating the power control part 173(F). At this time, electric power is supplied to the accommodating unit 3(F), making it possible to drive the driving components and sensors of the accommodating unit 3(F). Thus, electric power is supplied to the accommodating units 3(C), 3(F), in which the AC/DC conversion part 172 is connected to the third power supply line 183.

According to the first operation sequence of the second embodiment, it is possible to input electric power while suppressing inrush current. Moreover, as a result of dividing the power source system into three systems of the first power supply line 181, the second power supply line 182, and the third power supply line 183, the maximum rated current value per system can be further suppressed compared with the configuration of the first embodiment.

"Second Operation Sequence"

In the second operation sequence, in parallel with supplying electric power to the accommodating unit 3(A), in which the AC/DC conversion part 172 is connected to the first power supply line 181, electric power is supplied to the accommodating unit 3(B), in which the AC/DC conversion part 172 is connected to the second power supply line 182, and in parallel with these, electric power is supplied to the accommodating unit 3(C), in which the AC/DC conversion part 172 is connected to the third power supply line 183. After that, in parallel with supplying electric power to the accommodating unit 3(D), in which the AC/DC conversion part 172 is connected to the first power supply line 181, electric power is supplied to the accommodating unit 3(E), in which the AC/DC conversion part 172 is connected to the second power supply line 182, and in parallel with these, electric power is supplied to the accommodating unit 3(F), in which the AC/DC conversion part 172 is connected to the third power supply line 183.

First, the control part 32 of the counting unit 2 turns ON the first switch 135 on the power supply line 124, and, in parallel with this, turns ON the second switch 136 on the power supply line 125. Furthermore, in parallel with this, the control part 32 turns ON the third switch 137 on the power supply line 126. As a result, the AC/DC conversion part 172(A) connected to the power supply line 143(A) in the accommodating unit 3(A) converts an alternating current into a direct current to be output to the power control part 173(A), thereby activating the power control part 173(A). At this time, electric power is supplied to the accommodating unit 3(A), making it possible to drive the driving components and sensors of the accommodating unit 3(A). Moreover, the AC/DC conversion part 172(B) connected to the power supply line 143(B) within the accommodating unit 3(B) converts an alternating current into a direct current to be output to the power control part 173(B), thereby activating the power control part 173(B). At this time, electric power is supplied to the accommodating unit 3(B), making it possible to drive the driving components and sensors of the accommodating unit 3(B). Furthermore, the AC/DC conversion part 172(C) connected to the power supply line 143(C) within the accommodating unit 3(C) converts an alternating current into a direct current to be output to the power control part 173(C), thereby activating the power control part 173(C). At this time, electric power is supplied to the accommodating unit 3(C), making it possible to drive the driving components and sensors of the accommodating unit 3(C).

Next, the control part 32 of the counting unit 2 transmits a control signal to the power control part 173(A) of the accommodating unit 3(A) so that the switch 171(A) turns the power supply line 143(A) ON. In parallel with this, the control part 32 transmits a control signal to the power control part 173(B) of the accommodating unit 3(B) so that the switch 171(B) turns the power supply line 143(B) ON. Moreover, in parallel with these, the control part 32 transmits a control signal to the power control part 173(C) of the accommodating unit 3(C) so that the switch 171(C) turns the power supply line 143(C) ON.

Upon receiving the control signals, the power control part 173(A) of the accommodating unit 3(A) turns the power supply line 143(A) ON by means of the switch 171(A), the power control part 173(B) of the accommodating unit 3(B) turns the power supply line 143(B) ON by means of the switch 171(B), and the power control part 173(C) of the accommodating unit 3(C) turns the power supply line 143(C) ON by means of the switch 171(C).

Then, electric power is supplied from the power supply line 143(A) of the accommodating unit 3(A) to the AC/DC conversion part 172(D) of the accommodating unit 3(D) via the power supply line 145(B) of the accommodating unit 3(B), the power supply line 144(C) of the accommodating unit 3(C), and the power supply line 143(D) of the accommodating unit 3(D). The AC/DC conversion part 172(D) converts the alternating current into a direct current to be output to the power control part 173(D), thereby activating the power control part 173(D). At this time, electric power is supplied to the accommodating unit 3(D), making it possible to drive the driving components and sensors of the accommodating unit 3(D).

Moreover, electric power is supplied from the power supply line 143(B) of the accommodating unit 3(B) to the AC/DC conversion part 172(E) of the accommodating unit 3(E) via the power supply line 145(C) of the accommodating unit 3(C), the power supply line 144(D) of the accommodating unit 3(D), and the power supply line 143(E) of the accommodating unit 3(E). The AC/DC conversion part 172(E) converts the alternating current into a direct current to be output to the power control part 173(E), thereby activating the power control part 173(E). At this time, electric power is supplied to the accommodating unit 3(E), making it possible to drive the driving components and sensors of the accommodating unit 3(E).

Furthermore, electric power is supplied from the power supply line 143(C) of the accommodating unit 3(C) to the AC/DC conversion part 172(F) of the accommodating unit 3(F) via the power supply line 145(D) of the accommodating unit 3(D), the power supply line 144(E) of the accommodating unit 3(E), and the power supply line 143(F) of the accommodating unit 3(F). The AC/DC conversion part 172(F) converts the alternating current into a direct current to be output to the power control part 173(F), thereby activating the power control part 173(F). At this time, electric power is supplied to the accommodating unit 3(F), making it possible to drive the driving components and sensors of the accommodating unit 3(F).

As a result of the above, input of electric power to all of the accommodating units 3(A) to 3(F) is completed.

According to the second operation sequence of the second embodiment, it is possible to reduce the amount of time required to input electric power, compared with the first operation sequence.

In the above description, the case where the accommodating unit 3 of the paper sheet processing device 1 classifies and accommodates paper sheets therein has been described as an example. However, it is not limited to this, and it is sufficient that a unit is one that processes paper sheets.

Moreover, in the above description, the paper sheet processing device that processes paper sheets serving as media has been taken as an example and has been described as a medium processing device. However, it can also be applied to a coin processing device for processing coins as media.

A medium processing device according to one embodiment of the present invention includes a main body unit that counts a medium, the main body unit being configured to be connectable to at least one medium processing unit that accommodates the medium. The main body unit includes: a plurality of power supply lines including first and second power supply lines, the first and second power supply lines being independent of each other and supplying electric power toward the at least one medium processing unit, and an output part that outputs a control signal toward the at least one medium processing unit.

According to the above medium processing device, electric power is supplied from the main body unit to the at least one medium processing unit through the at least two power supply lines. Electric power supplied through these at least two power supply lines is controlled by the control signal output from the output part of the main body unit. As a result, it is possible to suppress the maximum rated current per power supply line. Therefore, it is possible to suppress an increase in cost.

The above medium processing device may further include the at least one medium processing unit. The at least one medium processing unit may include a first medium processing unit that is directly connected to the main body unit in a detachable manner and that receives the medium from the main body unit.

In the above medium processing device, the first medium processing unit may be configured to be connectable to a second medium processing unit that receives the medium from the first medium processing unit. The first medium processing unit may include: a plurality of power supply lines including a third power supply line that is connected to the first power supply line and that supplies the second medium processing unit with electric power supplied from the first power supply line, and a fourth power supply line that is independent of the third power supply line, that is connected to the second power supply line, and that supplies the second medium processing unit with electric power supplied from the second power supply line; and a power control part that performs control of switching the third power supply line from an off state where supply of electric power to the second medium processing unit is not possible to an on state where supply of electric power to the second medium processing unit is possible, according to the control signal from the main body unit.

According to the above medium processing device, since the power control part switches the third power supply line to the on state according to a control signal from the main body unit, the timing of supplying electric power can be shifted by means of communication control from the main body unit. This enables suppression of inrush current when input of electric power is performed.

In the above medium processing device, the third power supply line may be provided with a switching part for switching the third power supply line to the off state or the on state. The fourth power supply line may not be provided with a switching part for switching the fourth power supply line to the off state or the on state.

In the above medium processing device, the at least one medium processing unit may further include the second medium processing unit. The second medium processing unit may be directly connected to the first medium processing unit in a detachable manner. The second medium processing unit may be configured to be connectable to a third medium processing unit that receives the medium from the second medium processing unit. The second medium processing unit may include a plurality of power supply lines including a fifth power supply line connected to the third power supply line, and a sixth power supply line that is independent of the fifth power supply line and is connected to the fourth power supply line. The sixth power supply line may be provided with a switching part for switching the sixth power supply line from an off state where supply of electric power to the third medium processing unit is not possible and an on state where supply of electric power to the third medium processing unit is possible. The fifth power supply line may not be provided with a switching part for switching the fifth power supply line from an off state where supply of electric power to the third medium processing unit is not possible to an on state where supply of electric power to the third medium processing unit is possible.

According to the above medium processing device, the fifth power supply line provided with no switching part is connected to the third power supply line provided with a switching part. On the other hand, the sixth power supply line provided with a switching part is connected to the fourth power supply line provided with no switching part. As a result, it is possible, with a simple structure, to supply electric power to the first medium processing unit and to the second medium processing unit at different timings. Therefore, it is possible to further suppress an increase in cost.

In the above medium processing device, the at least one medium processing unit may further include the third medium processing unit. The third medium processing unit may be directly connected to the second medium processing unit in a detachable manner. The third medium processing unit may include a plurality of power supply lines including a seventh power supply line connected to the fifth power supply line, and an eighth power supply line that is independent of the seventh power supply line and is connected to the sixth power supply line. The seventh power supply line may be provided with a switching part for switching the seventh power supply line from an off state where supply of electric power to an external device outside the third medium processing unit is not possible to an on state where supply of electric power to the external device is possible. The eighth power supply line may not be provided with a switching part for switching the eighth power supply line from an off state where supply of electric power to the external device is not possible to an on state where supply of electric power to the external device is possible.

In the above medium processing device, the sixth power supply line may be switched to the on state after the third power supply line and the seventh power supply line are switched to the on state.

According to the above medium processing device, the sixth power supply line, which is not connected to the third and seventh power supply lines, is switched to the on state after all of the third and seventh power supply lines connected to each other have been switched to the on state. As a result, it is possible to suppress the maximum rated current per power supply line. Therefore, it is possible to suppress an increase in cost.

INDUSTRIAL APPLICABILITY

The present invention may be applied to a medium processing device.

REFERENCE SYMBOLS

1 Paper sheet processing device (medium processing device)
2 Counting unit (medium counting main body part, main body unit)
3 Accommodating unit (medium processing unit)
27A Connection transport constituent part (medium transport path)
124 to 126 Power supply line
138 I/F output part (output part)
141 Power input part
142 Power output part
143 to 145 Power supply line
171 Switch (switching device, switching part)
173 Power control part
S Paper sheet (medium)

The invention claimed is:

1. A medium processing device comprising:
a main body unit that counts a medium; and
at least one medium processing unit that accommodates the medium,
wherein the main body unit being configured to be connectable to the at least one medium processing unit,
wherein the main body unit includes:
a plurality of power supply lines including first and second power supply lines, the first and second power supply lines being independent of each other and supplying electric power toward the at least one medium processing unit, and
an output part that outputs a control signal toward the at least one medium processing unit,
wherein the at least one medium processing unit includes a first medium processing unit that is directly connected to the main body unit in a detachable manner and that receives the medium from the main body unit,
wherein the first medium processing unit is configured to be connectable to a second medium processing unit that receives the medium from the first medium processing unit, and
the first medium processing unit includes:
a plurality of power supply lines including
a third power supply line that is connected to the first power supply line and that supplies the second medium processing unit with electric power supplied from the first power supply line, and
a fourth power supply line that is independent of the third power supply line, that is connected to the second power supply line, and that supplies the second medium processing unit with electric power supplied from the second power supply line; and
a power control part that performs control of switching the third power supply line from an off state where supply of electric power to the second medium processing unit is not possible to an on state where supply of electric power to the second medium processing unit is possible, according to the control signal from the main body unit,
wherein the third power supply line is provided with a switching part for switching the third power supply line to the off state or the on state, and
the fourth power supply line is not provided with a switching part for switching the fourth power supply line to the off state or the on state.

2. The medium processing device according to claim 1,
wherein the at least one medium processing unit further includes the second medium processing unit,
the second medium processing unit is directly connected to the first medium processing unit in a detachable manner,
the second medium processing unit is configured to be connectable to a third medium processing unit that receives the medium from the second medium processing unit,
the second medium processing unit includes a plurality of power supply lines including
a fifth power supply line connected to the third power supply line, and
a sixth power supply line that is independent of the fifth power supply line and is connected to the fourth power supply line,
the sixth power supply line is provided with a switching part for switching the sixth power supply line from an off state where supply of electric power to the third medium processing unit is not possible and an on state where supply of electric power to the third medium processing unit is possible, and
the fifth power supply line is not provided with a switching part for switching the fifth power supply line from an off state where supply of electric power to the third medium processing unit is not possible to an on state where supply of electric power to the third medium processing unit is possible.

3. The medium processing device according to claim 2,
wherein the at least one medium processing unit further includes the third medium processing unit,
the third medium processing unit is directly connected to the second medium processing unit in a detachable manner,
the third medium processing unit includes a plurality of power supply lines including
a seventh power supply line connected to the fifth power supply line, and
an eighth power supply line that is independent of the seventh power supply line and is connected to the sixth power supply line,
the seventh power supply line is provided with a switching part for switching the seventh power supply line from an off state where supply of electric power to an external device outside the third medium processing unit is not possible to an on state where supply of electric power to the external device is possible, and
the eighth power supply line is not provided with a switching part for switching the eighth power supply line from an off state where supply of electric power to the external device is not possible to an on state where supply of electric power to the external device is possible.

4. The medium processing device according to claim 3, wherein the sixth power supply line is switched to the on state after the third power supply line and the seventh power supply line are switched to the on state.

5. The medium processing device according to claim 4, wherein the output part outputs the control signal to the second medium processing unit after the third power supply line and the seventh power supply line are switched to the on state, and when the second medium processing unit receives the control signal, the switching part of the second medium processing unit switches the sixth power supply line to the on state.

* * * * *